United States Patent [19]

Bull et al.

[11] 4,335,276

[45] Jun. 15, 1982

[54] APPARATUS FOR NON-INVASIVE MEASUREMENT AND DISPLAY NASALIZATION IN HUMAN SPEECH

[75] Inventors: Glen L. Bull; Wesley E. McDonald, both of Charlottesville; Milton T. Edgerton, Timbercreek, all of Va.

[73] Assignee: The University of Virginia, Charlottesville, Va.

[21] Appl. No.: 140,951

[22] Filed: Apr. 16, 1980

[51] Int. Cl.[3] ..... G10L 1/00

[52] U.S. Cl. ..... 179/1 SP; 179/1 SC

[58] Field of Search ..... 179/1 SC, 1 SP, 1 SE; 128/10, 731, 732, 635, 773; 434/319, 321

[56] References Cited

U.S. PATENT DOCUMENTS

| | | | |
|---|---|---|---|
| 2,416,353 | 2/1947 | Shipman et al. | 179/1 SP X |
| 3,281,534 | 10/1966 | Dersch | 128/630 |
| 3,383,466 | 5/1968 | Hillix et al. | 179/1 SC |
| 3,483,941 | 12/1969 | Brady | 179/1 SC |
| 3,646,576 | 2/1972 | Griggs et al. | 179/1 SC |
| 3,752,929 | 8/1973 | Fletcher | 179/1 SC |
| 3,846,586 | 11/1974 | Griggs | 179/1 SC |
| 3,855,416 | 12/1974 | Fuller | 179/1 SP |
| 3,881,059 | 4/1975 | Stewart | 179/1 SP |
| 3,906,936 | 9/1975 | Habal | 128/724 |
| 4,015,088 | 3/1977 | Dubnowski et al. | 179/1 SC |
| 4,061,041 | 12/1977 | Fletcher et al. | 73/646 |
| 4,074,069 | 2/1978 | Tokura et al. | 179/1 SC |
| 4,187,396 | 2/1980 | Luhowy | 179/1 SC |

OTHER PUBLICATIONS

The Effects Of Feedback Filtering On Nasalization, Sharon R. Garber, Ph.D., Presented at Convention of the American Speech and Hearing Association, Houston, Texas, Nov. 21, 1976.

A Miniature Accelerometer For Detecting Glottal Waveforms and Nasalization, Stevens et al, Journal of Speech and Hearing Disorder, vol. XXXVII, 3.

Contingencies for Bioelectronic Modification of Nasality, Fletcher, Quan-Tech, Reprint from Journal of Speech and Hearing Disorder, Aug. 1972, vol. 37, No. 3.

Chu, et al, "An Electro-Acoustical Technique etc.", Medical Research Eng., vol. 12, No. 1, pp. 18-20.

*Primary Examiner*—Mark E. Nusbaum
*Assistant Examiner*—E. S. Kemeny
*Attorney, Agent, or Firm*—Oblon, Fisher, Spivak, McClelland & Maier

[57] ABSTRACT

An apparatus for the acquisiton of a raw speech signal and the essentially simultaneous acquisition of a transform of the speech signal, wherein said transform covaries as a function of changes in one or more parameters in the speech signal and is indicative of a predetermined selected speech characteristic, such as nasalization, pitch or intensity. The apparatus includes a microphone for producing first signals representative of raw speech, and a second transducer, such as, for example, an accelerometer for generating second signals essentially simultaneous to the production of the first signals, with the second signals being indicative of a selected parameteric characteristic of the human speech, such as, for example, nasalization. The first and second signals are applied to data processing circuits which analyzes the first and second signals to produce transform signals based on arithmetic combinations thereof. The apparatus further includes display means for providing videographic and alphanumeric display of the transform signals accompanied by synchronous audio display of the raw speech.

20 Claims, 20 Drawing Figures

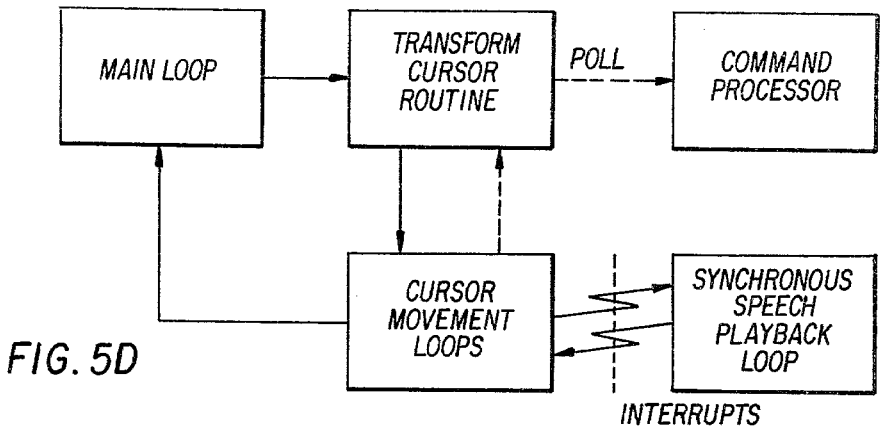
FIG. 5D
FIG. 6A
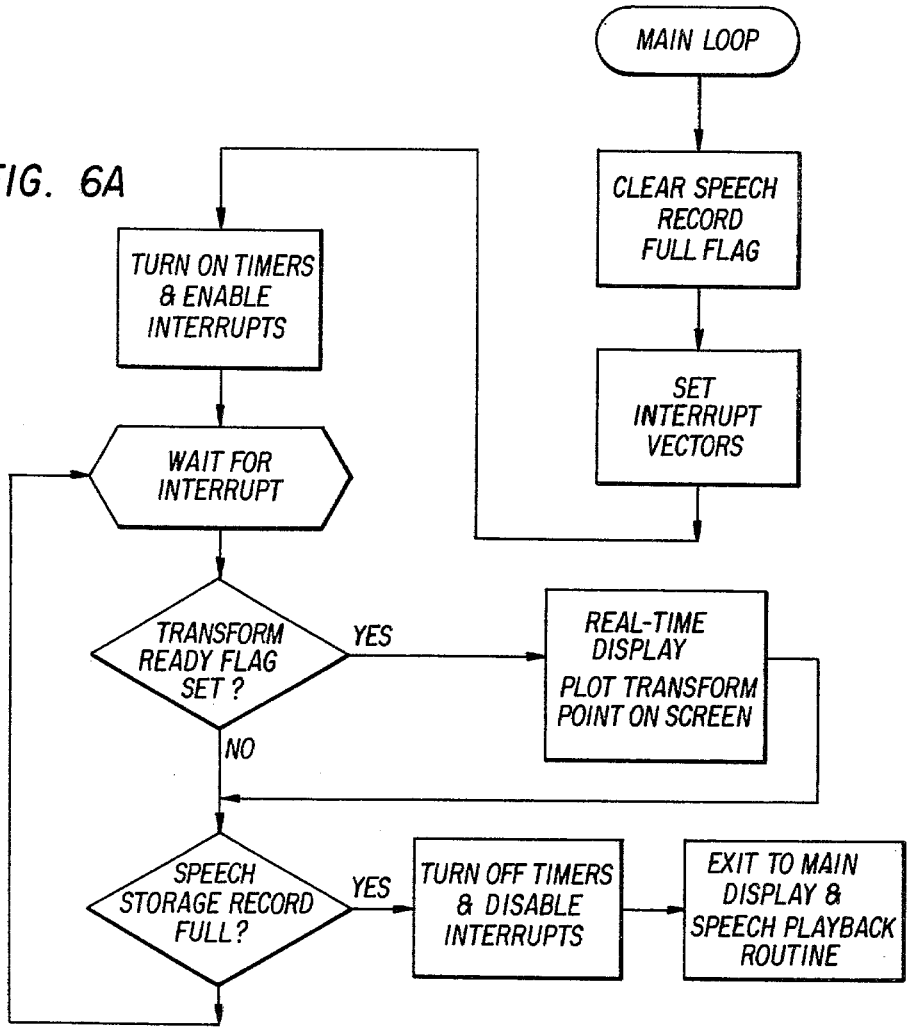

NOTE: RETURN IS TO POINT WHERE INTERRUPTED BY SPEECH TAKER

A = ENTRY POINT TO TRANSFORM CURSOR LOOP
B = CURSOR HALT ROUTINE
C = " LEFT "
D = " RIGHT "

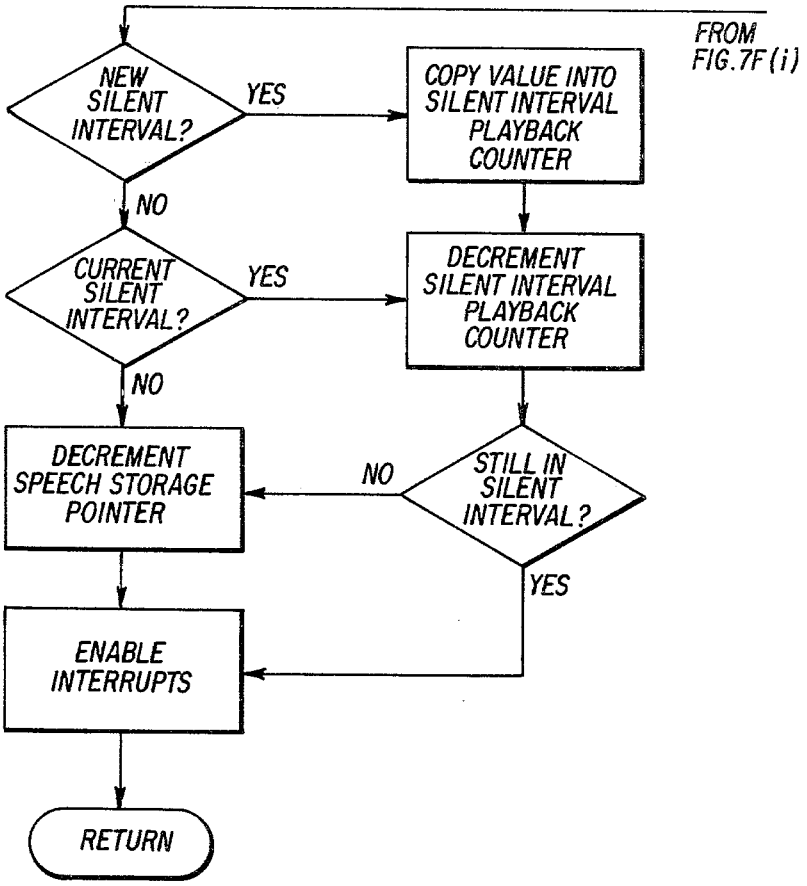
FIG. 7F (ii)

APPARATUS FOR NON-INVASIVE MEASUREMENT AND DISPLAY NASALIZATION IN HUMAN SPEECH

BACKGROUND OF THE INVENTION

1. Field of the Invention

This invention relates to an apparatus for the non-invasive detection and treatment of speech disorders, especially disorders effecting speech nasalization, and more particularly to such an apparatus for generation of quantitative predictive information related to underlying physiological and perceptual correlates of nasal resonance.

2. Description of the Prior Art

Early efforts at diagnosis and treatment of disorders of nasal resonance have been based on perceptual assessments of the patient's speech by the clinician. This approach has suffered for several reasons. Consistency of judgments among clinicians, dependent upon extensive clinical training, is often lacking. The subjective judgment is an assessment of the overall quality of the patient's speech, and therefore definition of specific attributes which give rise to the problem is poor. Feedback to the patient is delayed rather than immediate. Therefore, recent efforts have focused on development of methods which provide consistent, repeatable results with greater immediacy, and greater specificity with respect to definition of the problem.

In U.S. Pat. No. 3,752,929 to Fletcher is described a process and apparatus in which electrical signals representative of the sounds emitted from the nose and mouth are utilized to determine the degree of nasalance of speech. In this apparatus, a pair of sound-isolated microphones are carried in the housing adapted to be brought into place about the face of the patient in order to respectively measure sounds emanating from the nasal and oral cavities. The outputs of the microphones are filtered for respective frequency bands thought to have high nasal and oral content, and a ratio of the filtered microphone outputs computed to obtain a quotient signal which is then threshold detected against a reference representing a known degree of nasality. Then the output of the threshold detector is applied to a visual display such as a lamp by which the patient can determine whether or not a given sentence contains more or less nasalance relative to the reference established by the threshold detector.

The approach outlined in the Fletcher patent, which represented a major advance in providing a practical quantitative measure of disorders of nasal resonance, nevertheless requires that the patient place his face in the mask which provides acoustic isolation between the microphones and thereby permits separation of the oral and nasal acoustic signals. Unfortunately, the use of the facial mask requires that the patient place his head in a stable position, and further limits interaction between the patient and the clinician. This may present severe difficulties with young children or paralyzed patients who comprise a large percentage of the population seen in the clinic for defective velopharynseal valving. Furthermore, the degree of separation and acoustic isolation between the microphones has been questioned.

An alternate approach devised by Stephens et al, "A Miniature Accelerometer for Detecting Glottal Waveforms and Nasalization," J. Speech Hearing Res. 18 (1975), 594–599, utilized a light-weight accelerometer attached to the external surface of the nose for measuring nasal vibration during speech to obtain a quantitative measure related to nasality. Stephens et al filters, rectifies, and time averages the output of the accelerometer. Then, with the aid of a computer, the smooth signal is sampled, log converted and displayed on an oscilloscope to provide a visual display of nasalization.

In a related development, Garber et al, "The Effects of Feedback Filtering on Nasalization in Normal and Hypernasal Speakers," J. Speech Hearing Res. 22 (1979), 321–333, in order to investigate the effect of auditory feedback on vocal production and nasalization in particular, tested the effects on the nasalization of various subjects who listened to their speech filtered at various frequencies. Thus, Garber et al have investigated whether production of nasal quality would change when subjects hear their voices filtered. In implementing their study, Garber et al used the output of an accelerometer of the type employed by Stephens et al placed on the nose to obtain a measure of nasalization. The output of the accelerometer was first routed to a tape recorder. The recorded signal was later transferred to a graphic level recorder and analyzed through measurement of peaks in the signal with respect to a prerecorded calibration tone. The arithmetic average of measured peaks constituted the nasalization score.

To validate the measurement, a preliminary study was conducted in which subjects were requested to speak at various intensity levels. The Pearson product-moment correlation between accelerometer output and perceptual judgments of nasality was 0.77. A correction factor was then introduced to compensate for intensity differences between the various conditions by subtracting each subject's vocal level from an arbitrary reference level, dividing this value by two, and adding it to the subject's nasalization score. After adjustment of scores in this manner, the correlation reported between accelerometer output and perceived nasality was 0.82. In this manner it was determined that the nasalization score accounted for 67% of the variance in nasality, provided that intensity level was held constant. An attempt was made to hold the intensity level constant in the main study described in the preceding paragraph by requesting subjects to speak at a constant vocal effort. A visual display of vocal intensity was provided to facilitate maintenance of constant vocal effort.

The measurement technique developed by Garber et al lacks instantaneous quantification and therefore lacks the immediate feedback necessary for efficient immediate modification of speech production. In the form implemented, the technique also requires that subjects maintain constant vocal effort to maximize accuracy of the measure.

SUMMARY OF THE INVENTION

Accordingly, it is an object of the present invention to provide a novel apparatus for non-invasive measurement and display of nasalization in human speech which provides immediate feedback by which a patient can monitor, evaluate and modify his speech for nasalization.

Another object is to provide a novel apparatus which can provide feedback facilitating second language learning in instances in which the set of nasal phonemes in the second language differs from those of the speaker's native language.

Another object is to provide a novel apparatus of the type noted above capable of deriving a measure which provides predictive information with respect to related physiological events and perceptual correlates of nasal resonance.

Yet another object of this invention is to provide a novel apparatus which provides diagnostic information about the relative severity of disorders of nasal resonance and sorts patients into diagnostic categories based on the range of the measures obtained for productions of nasal and non-nasal phonemes.

Yet another object of this invention is to provide a novel apparatus which permits identification of the phonemic content of speech associated with specific sections of a static graphic display of the measure of nasalization over time.

Yet another object of this invention is to provide a novel apparatus which permits identification of the rate and slope of the transition from a nasal to a non-nasal phoneme.

Yet another object of this invention is to provide a portable, easily implemented apparatus which provides consistent, repeatable measures which provide a meaningful basis for comparisons among patients as well as a basis for recording progress within a given patient with a disorder of nasal resonance.

Another object of this invention is to provide a novel apparatus which permits identification of the phonemic content of speech associated with specific sections of static graphic displays of measures of other transforms of speech such as intensity and pitch over time.

These and other objects are achieved according to the invention by providing a new and improved apparatus for non-invasive measurement and display of nasalization in human speech including the following sections: two transducers (an accelerometer and a directional microphone), an analog proprocessing section, an analog-to-digital converter, a digital data processor, a display section, and a control panel.

The accelerometer is mounted on the external nasal wall for measurement of nasal wall vibration, while airborne sound consisting of combined nasal and oral output is transduced by the directional microphone. The microphone is mounted on a headset to maintain a constant position with respect to the subject's lips. In the analog preprocessing section the accelerometer and microphone outputs are amplified, RMS averaged and transferred to a multiplexer in the analog-to-digital conversion section. A 30 Hz highpass filter with a 12 dB per octave slope on the output of the accelerometer can be enabled to compensate for artifacts associated with turning and other movements of the head which would otherwise be recorded by the accelerometer. The amplified output of the raw speech signal is also transferred to the multiplexer to provide a record of the speech associated with time-varying ratios formed from the two RMS signals. An AGC circuit on the output of the raw speech channel can be enabled to improve the fidelity of transient consonants such as voiceless /th/ which have an inherently low relative intensity level.

The two RMS signals are provided in two forms: linear and logarithmic. The two logarithmic RMS signals are sampled at a 500 Hz rate by the analog-to-digital converter as the raw speech signal is sampled at an either kHz rate. The digital processor, which utilizes an eight-bit microcomputer of the 8080/8085/Z80 family of microprocessors, controls the multiplexing and analog-to-digital conversion of the respective signals. The digital processor forms a ratio of accelerometer output over microphone output for each successive pair of samples from the two RMS channels. Thus a new ratio is formed every two milliseconds. The measure acquired, therefore, consists of a ratio of vibration at the nasal wall transduced by an accelerometer over the combined oral and nasal acoustic outputs transduced by the microphone. In this mode of operation, the logarithm of each ratio acquired is formed to facilitate recognition of patterns present in a graphic display of the ratios.

A ratio of the two linear RMS signals is formed by means of a divider circuit in hardware. The digital processor then acquires the signal formed by the output of the divider circuit at a 500 Hz rate as the raw speech signal is sampled at an eight KHz rate. Selection of a linear or logarithmic ratio is controlled through commands input through the command keyboard on the control panel.

The ratios over time are plotted as a line on a display. An upward or downward shift represents a proportionately greater or lesser degree of nasalization. The arithmetic average of all ratios formed for the utterance recorded is displayed in the lower right-hand corner of the screen.

The digitized signal from the raw speech channel is stored concurrently with the ratios formed from the sampled RMS channels in such a manner that the relative relationship in time between the ratios and the digitized audio signal is preserved. A moving cursor can be advanced across the graphic plot synchronously with the replayed audio signal, permitting identification of the phonemic content associated with a given segment of the plot. This is accomplished by means of a toggle with three positions: cursor right, cursor left, and halt. A binary code corresponding to each position of the toggle is sent to the digital controller, which directs the movement of the cursor accordingly.

When the cursor is halted, the instantaneous value of the ratio and the time in milliseconds at that point in the utterance are displayed in the lower and upper right-hand corners of the screen respectively. Thus the absolute value of a ratio formed at a specific time in the utterance can be determined, as well as the arithmetic average of all ratios formed for the entire utterance.

Digitization of the audio signal from the raw speech channel at an eight KHz rate requires one byte of memory for each digitized sampled stored. Thus direct storage of a signal sampled at an eight kHz rate for one second would require 8000 bytes of memory. The eight-bit microprocessor utilizes a 16-bit address bus, permitting a maximum of 64 kilobytes of memory to be addressed, placing the upper limit on the duration of the speech signal which can be stored. To conserve memory and extend the maximum length of utterances which can be recorded, the duration of silent intervals in perceptually continuous speech is coded, rather than storing each sample with a value of zero as a separate byte. During playback of the digitized speech signal, a series of zeros is then sent to the digital-to-analog converter for the duration coded at that point in the stored signal. This results in an appreciable savings in memory required for storage of the digitized speech signal.

Contraction of the musculature associated with lip movement which accompanies production of labial consonants such as /P/ creates a slight but rapid movement of the nasal wall in some individuals. When the speed of this movement exceeds the frequency of the 30 Hz filter on the output of the accelerometer, an artifact consisting of a sharp spurious peak in the graphic display is formed. Several forms of signal processing can be enabled through commands from the control panel to remove sharp spurious peaks unrelated to nasalization, including algorithms which implement a Hanning window and/or various median filters.

Advantageously, the apparatus of the invention is calibrated to yield consistent, repeatable measurements from each subject as well as to facilitate comparisons across subjects. Placement of the accelerometer at slightly different points on the nasal wall can alter the signal transduced by the accelerometer due to differing transmission characteristics of various positions on the nasal wall. Slight differences in placement of the directional microphone positioned in front of the lips by means of a headset can also introduce variability in the measure acquired. Since it would be difficult to guarantee that accelerometer and microphone placement remained constant from evaluation to evaluation, repeatable measurements within a given subject could not be maintained between evaluations without provision for some manner of calibration. Further, physiological variation among individuals introduces further variability which limits comparison of similar measurements acquired from separate individuals in the absence of any calibration procedure.

The calibration procedure implemented is based on two phenomena. First, maximal acoustic transmission through the nasal passages will typically be observed during production of the nasal consonant /m/, whether the individual is normal, hypernasal, or denasal. This is due to the fact that the oral passage is sealed by closure of the lips during production of /m/, and therefore the nasal passage is the only pathway open for transmission of the sound. Accordingly, the gain of the accelerometer RMS circuit is adjusted to a common level for all subjects during production of /m/. This is accomplished by means of an accelerometer gain control on the control panel and target bars on the display screen controlled by the digital processor. As the patient produces /m/, a line traverses the screen. The clinician then adjusts the accelerometer RMS gain until the moving line falls within the target bars.

Second, maximal acoustic transmission through the oral passage is typically observed during production of the phoneme /a/, whether the individual is normal, hypernasal, or denasal. This is a result of the fact that there is minimal constriction of the oral passage during production of /a/. Accordingly, the gain of the microphone RMS circuit is adjusted to a common level for all subjects during production of /a/. This is accomplished by a means parallel to that described for adjustment of the accelerometer gain control in the preceding paragraph.

After calibration of the apparatus in this manner, the outputs of the accelerometer and microphone RMS circuits are adjusted to an equivalent level for production of /m/ and /a/ respectively for all subjects. Calibration by this method yields a range for production of nasal and non-nasal phonemes which is restricted for hypernasal subjects in comparison with normal subjects. (FIG. 1) It also facilitates comparisons among subjects and minimizes variation due to extraneous factors for repeated measures within the same subject.

The principle underlying operation of the apparatus has its basis in the observation that sound is transmitted to the nasal wall and manifested in the form of vibration during production of speech. The amplitude of the vibration is increased during production of the three nasal English phonemes /m/, /n/, and /ng/ by normal speakers, as a consequence of decreased separation between the oral and nasal cavities. This separation is normally maintaining during production of non-nasal phonemes by means of a physiological action termed velopharyn-seal closure. This consists of a upward and backward movement of the velum accompanied by medial movement of the lateral pharyngeal walls, producing a seal or closure at the nasal port. Inadequate velopharyngeal closure may result from organic deficits such as muscular paralysis or structural damage, or from an inappropriate learned behavioral pattern in the absence of any physiologic deficit. When this occurs, phonemes other than the three English nasal consonants are nasalized.

This oral-nasal separation is increased during production of non-nasal phonemes and decreased during production of nasal phonemes (/m/, /n/, and /ns/) by a normal speaker, by means of the appropriate physiologic movements. Therefore the assumption that oral-nasal separation is maximal during production of non-nasal phonemes and minimal during production of nasal phonemes by a normal speaker appears to be reasonable. Alternation of nasal and non-nasal phonemes such as /m/ and /a/ by a normal speaker produces a graphic display resembling a square wave in which the top portions of the waveform correspond to productions of the nasal phoneme and the bottom portions of the waveform correspond to productions of the non-nasal phoneme (FIG. 3). Thus, the additional assumption that the measure acquired reflects an underlying physiologic movement associated with oral-nasal separation also appears to be reasonable. The degree of oral constriction present also effects oral-nasal output. Accordingly, an assumption underlying development of the apparatus and its clinical application is that the measure produced reflects associated physiological movement related to velopharyngeal closure and oral constriction. Direct confirmation of the train of logic outlined must be based on a simultaneous comparison of a physiologic measure, such as a videofluorographic recording of velopharyngeal closure, synchronous with a record of the measure of nasalization acquired by means of the newly-developed apparatus described herein. However, conclusions drawn with respect to the relationship between the measure and underlying physiologic events are consistent with evidence developed to date.

Transitions between nasal and non-nasal phonemes are marked by leading and trailing edges between separate levels in the graphic display, except in the instance of severely disordered patients. Further, control of the moving cursor which traverses the graphic plot synchronous with the simultaneously replayed audio signal permits verification not only of the phonemic content associated with each segment of the plot, but identification of the beginning and end of each phoneme as well. To determine the rate of a shift from a nasal to non-nasal phoneme, or vice versa, the user aligns the cursor with a point concurrent with the beginning of a shift in the ratio, and types 'B' (for BEGINNING) on the control panel. The cursor is then moved to a point concurrent with the end of the shift and after which the user types 'E' (for END) on the control panel. The ratio shift rate is then calculated by the digital processor as the absolute value of the ratio at the beginning of the shift minus the ratio at the end of the shift divided by the duration of the shift in milliseconds::Ratio 1–Ratio 2:/Duration.

The procedure described for acquisition of the raw speech signal and a nasalization transform consisting of a ratio of accelometer output divided by microphone output can also be applied to acquisition of other transforms of the raw speech signal such as pitch and intensity. The intensity transforms of the raw speech signal may be acquired by sampling the logarithmic RMS signal from the microphone channel, while other transforms such as pitch may be acquired by means of an auxiliary input in the system.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
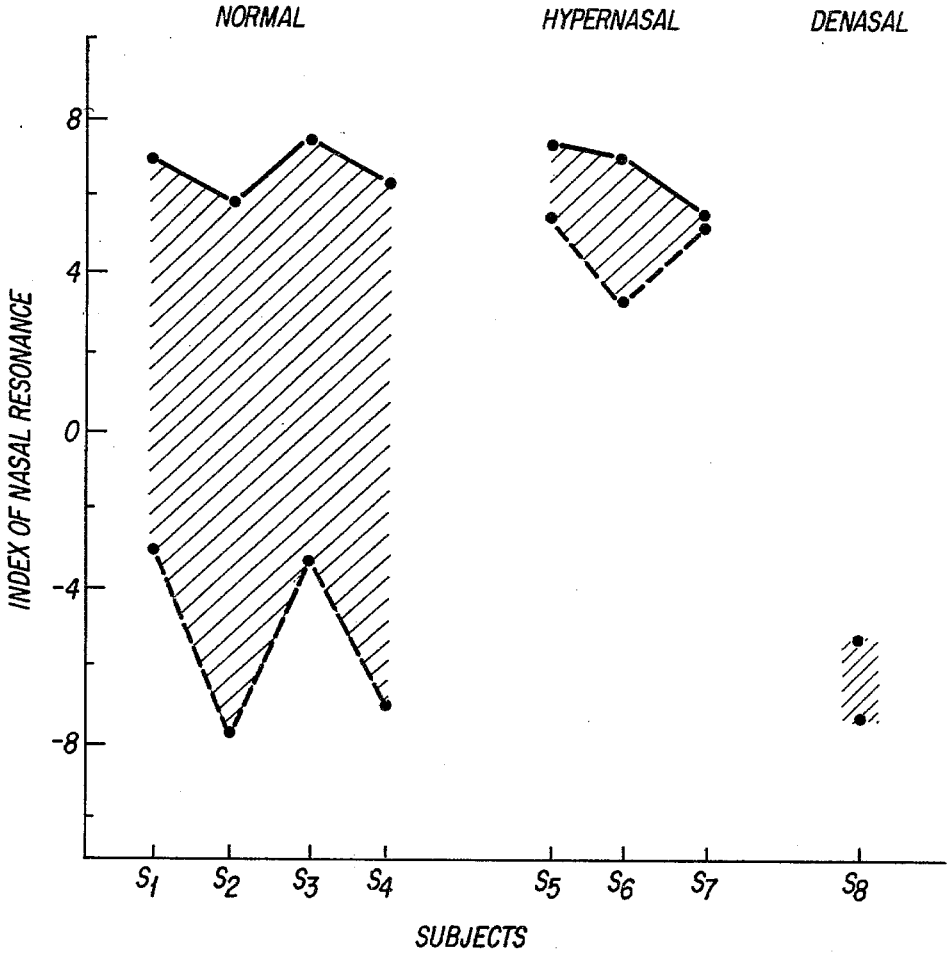
FIG. 1 is a microcomputer-based graphical index of nasal resonance for four normal human subjects, three hypernasal human subjects, and on subject exhibiting denasal speech.

Referring now to the drawings, wherein like reference numerals designate identical or corresponding parts throughout the several views, and more particularly to FIG. 1 thereof, there is shown graphically a microcomputer-based index of nasal resonance obtained for four normal subjects, three hypernasal patients, and one patient exhibiting denasal speech. The hypernasal subjects consisted of a cerebral-palsied patient (S5) and two patients with surgically-repaired clefts of the palate (S6 and S7). The measures obtained were determined by computing the logarithmic ratio of the nasal signal (derived from a lightweight, one-tenth ounce accelerometer placed on the nasal wall with double-sided tape) to the combined oral and nasal signal (derived from the output of a microphone placed six inches from the speaker). The dashed (lower) boundary indicates the averaged measure computed by the instrument for production of a non-nasal utterance: "Please use daises". The solid (upper) boundary indicates the averaged measure computed by the instrument for production of an utterance containing nasal consonants: "New pennies shine". The stippled area between the upper and lower boundaries indicates the range of the measure obtained for each subject during production of nasal and non-nasal utterances. The range obtained for the hypernasal subjects was restricted in comparison with that found for normal subjects. The range of the patient exhibiting denasal speech was also restricted in comparison with normal subjects, but was limited to the non-nasal rather than the nasal end of the continuum.

The apparatus according to the invention provides means of acquiring a digitized speech signal through one input simultaneously with the acquisition of a transform of the speech signal through other input channels, and is particularly useful in the diagnosis and treatment of nasalization, the clinical symptoms of which are readily amenable to transformation as shown in FIG. 1. A static graphic plot of the transform vs time is produced, with the capability provided for movement of a cursor across the plot of the transform synchronously with the replayed digitized speech signal.

Figure 2:
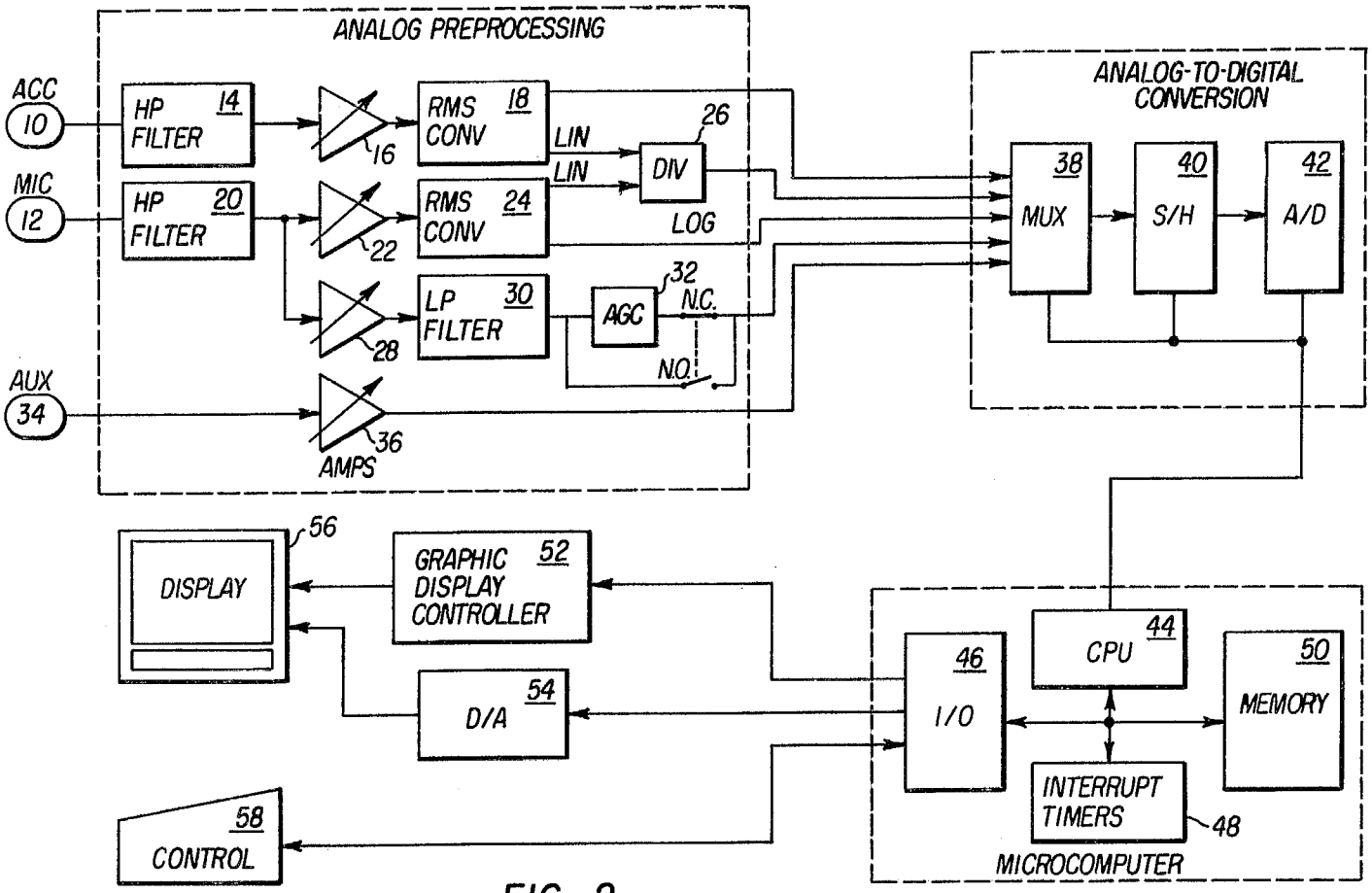
FIG. 2 is a block diagram illustrating the essential components of the apparatus of the invention.

Referring to FIG. 2, the nasalization measuring apparatus of one embodiment of the invention is seen to include accelerometer 10, a directional microphone attached to a boom and headset 12, high-pass filter 14, accelerometer RMS gain adjustment 16, accelerometer RMS conversion circuit 18, high-pass filter 20, microphone RMS gain adjustment 22, microphone RMS conversion circuit 24, divider circuit 26 which yields the output of the linear output of RMS conversion circuit 18 divided by the linear output of RMS conversion circuit 24, microphone raw speech gain adjustment 28, low-pass filter 30, automatic gain control 32, auxiliary input 34, auxiliary gain control 36, multiplexer 38, sample-and-hold circuit 40, analog-to-digital converter 42, digital processor 44, input/output circuit 46, interrupt timer 48, memory 50, graphic display controller 52, analog-to-digital converter 54, video and audio display 56, and control unit 58.

The accelerometer (10) utilized consists of a Bolt, Beranek, and Newman Model 501 accelerometer or equivalent, while the headset and directional microphone (12) employed is an R-Columbia headset or equivalent. The RMS conversion circuits (12 and 24) utilize an Analog Devices AD536A or equivalent, while the divider circuit (26) utilizes an Analog Devices AD535JH or equivalent. The multiplexer circuit (38) employed utilizes an Analog Devices AD7511DIJH or equivalent, and the sample-and-hold circuit (40) utilizes an Analog Devices AD582KH. The analog-to-digital converter (42) employed utilizes an Analog Devices AD571KD or equivalent. The digital processor (44) employed utilizes an Intel 8085A microprocessor or equivalent, while input/output circuitry (46) employed utilizes an Intel 8155 or equivalent. Memory (50) employed utilizes an array of Intel 2114L-3 random access memory or equivalent and an array of Intel 2708-1 programmable read-only memory or equivalent. The graphic display controller (52) utilizes a Matrox ALT-256 or equivalent, which digital-to-analog circuitry employed utilizes a Datel UP8BC or equivalent. The visual display screen of the visual display consists of a Hitachi VM129U video monitor or equivalent. The control panel (58) consists of a George Risk Industries Model 756 keyboard and enclosure or equivalent and a spring-loaded single-pole single-throw on-off-on cursor-control toggle.

High-pass filters 14 and 20, each with a 30 Hz cut-off frequency and a 12 dB per octave slope, directly follow the outputs of the accelerometer and microphone respectively to ensure that motion artifacts relating to shifting of the subject's head are minimized. Low-pass filter 30 with a 4 KHz cut-off frequency and a 12 dB per octave slope directly follows the output of microphone raw speech gain adjustment 26 of the instantaneous microphone output channel to ensure that sampling requirements for digitization of the signal are met. AGC circuit 32 which can be switched into the circuit following low-pass filter 30 has a time constant of 50 milliseconds and a compression range of 15 dB.

During operation, the accelerometer is taped to the skin of the nose overlying the lower lateral cartilage and measures vibration of the external nasal wall, while the microphone is positioned at a standardized distance in front of the patient by means of a headset to measure overall vocal intensity. An alternate approach consists of a placement of a second accelerometer on the midline of the external wall of the throat between the cricoid cartilage and the sternum. However, the intensity of nasal phonemes measured by means of a microphone placed before the subject's lips is often reduced with respect to the intensity of non-nasal phonemes such as /a/. This is due in part to the resistance presented by baffles such as the nasal turbinates to the flow of air through the nasal passages. In contrast, the difference between the intensity of nasal and non-nasal phonemes measured by means of an accelerometer placed on the midline of the throat below the larynx is typically not as pronounced. Thus, use of a microphone placed before the lips may provide greater differentiation between production of nasal and non-nasal phonemes. Adoption of a directional microphone makes it possible to adjust the tilt of the microphone to minimize the contribution of nasal output to the microphone input, further improving differentiation between nasal and non-nasal phonemes.

The outputs of the accelerometer and microphone are applied to adjustable gain and RMS conversion circuits 16 and 18, and 22 and 24, respectively. These amplify, rectify, and produce an output signal indicative of the RMS level of the respective inputs thereto. The output of the directional microphone is also applied to adjustable gain circuit 28 followed by low-pass filter 30, whose output may be applied either to automatic gain control circuit 32 or directly to multiplexer 38. The logarithmic RMS-converted accelerometer output of circuit 18, the logarithmic RMS-converted microphone output of circuit 24, as well as the instantaneous microphone output of circuit 30 (either directly or by way of automatic gain control circuit 30), and the output of circuit 36 are applied to the input ports of multiplexer 38, and may be multiplexed under the control of the digital processor. RMS circuits 18 and 24 each provide one output which is linear and one output which is logarithmic. The linear outputs are applied to divider circuit 26 which yields as its output the ratio of the linear output of circuit 18 divided by the linear output of circuit 24. The output of divider circuit 26, in turn, is applied to an input port of multiplexer 38. This way, the multiplexer 38 produces at its output one of the outputs of circuits 18, 24, 26, 30 or 36 for sampling by sample-and-hold circuit 40 prior to analog-to-digital conversion by the converter 42. The analog-to-digital converter 42 samples the output of the sample-and-hold circuit 40 under control of the digital processor and produces a digital output which is appied to the digital processor 44 and stored in memory 50. The RMS-conversion circuits 18 and 24 are designed with a 30 Hz bandwidth, while the outputs of circuits 18 and 24 are sampled at a 500 Hz rate by multiplexer 26. The output of circuit 30 (which may be directed through automatic gain control circuit 32) is sampled at an eight KHz rate.

During construction of the logarithmic nasalization transform of the raw speech signal, digital processor 44 of the apparatus of the invention alternately accepts the logarithmic RMS-converted accelerometer output, logarithmic RMS-converted microphone output, and instantaneous microphone output from the analog-to-digital converter at intervals which result in the appropriate sampling rates for each channel. As each pair of samples is acquired form the two RMS-conversion channels, the digital processor forms the logarithmic ratio of the relative power levels of the essentially simultaneously produced outputs. The logarithmic outputs of RMS circuits 18 and 24 are selected for sampling through appropriate selection of the channels sampled by multiplexer 36. Formation of the linear nasalization transform is similar, except that the ratio is acquired directly from the output of divider circuit 26. The ratio for the linear nasalization transform can alternately be formed through software rather than by means of divider circuit 26, at the expense of a substantial increase in time required for execution of the software routines which form the ratio. The ratio for the logarithmic nasalization transform can alternately be formed by means of a divider circuit in hardware, but formation of the ratio requires only a simple subtraction of the logarithmic output of circuit 24 from the logarithmic output of circuit 18, and consequently can be accomplished with little added complexity in software.

Formation of the ratio of the outputs of RMS circuits 18 and 24 provides an output, normalized by the appropriate calibration procedures, necessary to account for changes in the relative intensities of nasal wall vibration and overall acoustic output produced by the patient's speech. This ratio provides an index of the physiological events which underlie this process. The primary underlying physiologic events which affect the outputs measured include velopharyngeal closure, oral constriction, and respiratory airflow. Decreased velopharyngeal closure, increased oral constriction, and increased airflow result in increased nasal wall vibration relative to overall acoustic output intensity level. Thus the ratio of these outputs represents the summation of these underlying physiologic events and hence is a useful quantitative measurement of patient nasalization. In addition, the digital processor includes a table memory for storing perceptual correlates corresponding to the predetermined ranges of the physiological correlates established by the ratios of the averaged accelerometer and microphone outputs. The perceptual correlates are based on a comparison of a data base of judgments of nasality by trained speech pathologists with ratios of the averaged accelerometer and microphone outputs for the same corpus of utterances. The perceptual assessments are based on judgments of test passages spoken by normal speakers and by individuals with varying degrees of hypernasality to define a range, for example 1–5. By this means an individual patient, after repeating the identical test passage, is provided with the rating on the perceptual scale which corresponds to the equivalent perceptual range obtained for patients in the data base whose utterances yielded similar ratios.

Either arithmetic or logarithmic ratios and the associated raw speech signal corresponding thereto may also be stored in memory 50. The digital processor 44 has applied thereto a control signal from the transform-cursor toggle on the control panel by which a cursor is made to transverse the graphic pot of stored ratios synchronously with the digitized and stored speech associated with the graphically displayed ratios. Processor 44 includes an output to the graphic diaplay controller 52 and an output port by which the graphic plot of ratios and alphanumeric information are presented on the video portion of display 56; the processor also controls the output of digitized speech to digital-to-analog converter 50 whereby speech associated with the segment of the plot of ratios traversed by the cursor is replayed synchronously with movement of the cursor. The replayed speech signal is output through the audio portion of display 56 consisting of a power supply, an amplifier, 4 KHz low-pass filter, and a loudspeaker.

Figure 3:
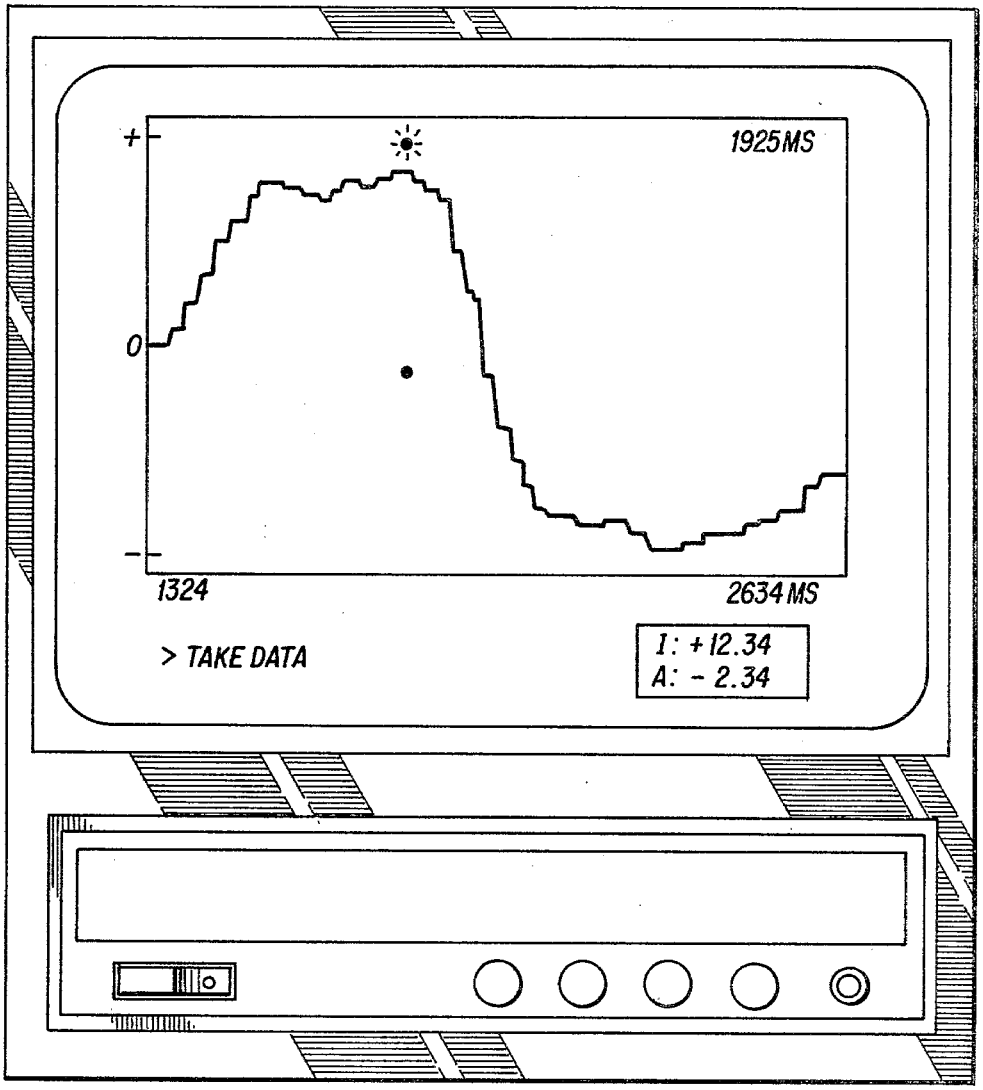
FIGS. 3 and 4 are sketches illustrating displays of the apparatus of the invention, and FIGS. 5A–5D, 6A–6E and 7A–7E, 7F(i) and 7F(ii) are diagrams of the flow of the program which drives the apparatus illustrated in FIGS. 2, 3 and 4.

Shown in FIG. 3 is a typical display of the correlates of nasalization presented on the video display. Commands to the processor from the control panel are echoed in the lower left-hand corner of the screen prior to execution. The graphic plot is that of alternate productions of the non-nasal and nasal phonemes /m/ and /a/ by a normal speaker. An upward or downward deflection of the graph represents a proportionately greater or lesser degree of nasalization. The section of the plot found in the upper portion of the screen resulted from production of /m/, and the section found in the lower portion of the screen resulted from production of /a/, with the transition between the two phonemes found between. Thus, the graphic plot differentiates production of the nasal and non-nasal phonemes displayed. Nasalization of the non-nasal phoneme by a hypernasal speaker results in an upward deflection of the plot, decreasing the range between alternate productions of nasal and non-nasal phonemes. Utterances containing no nasal phonemes provide test passages which yield benchmarks indicating the degree of deflection from results obtained from productions by normal speakers. A moving cursor is advanced across the graphic plot synchronously with the replayed audio signal associated with the segment of the plot which the cursor is traversing, permitting identification of the phonemic content of a given segment. The average (A) of all ratios acquired for a recorded utterance is displayed numerically in the lower right-hand corner of the screen beneath the numeric display of the instantaneous value (I) of the ratio at the point at which the cursor is halted. When the cursor is halted, the time in milliseconds of that point in the utterance is displayed in the upper right-hand corner of the screen.

The visual display screen consists of a standard video monitor such as a 12 or 19 inch Hitachi video monitor or equivalent, with the visual display controlled by a graphic display controller such as the Matrox ALT-256 or equivalent. Alternatively, an oscilliscopic display such as a Techtronics 5103N or equivalent can be employed for display of the graphic plot with numeric information either displayed on seven-segment light emitting diodes or on the face of the oscilloscope itself. In this instance, the graphic plot displayed on the oscilloscope is generated by digital-to-analog converters which drive the X and Y axes of the oscilloscope. Numeric information displayed on the face of the oscilloscope is controlled by a character-generator for display of dot matrix figures constructed in hardware or software. However, the size of the display screen in the instance of a standard 12 or 19 inch video monitor is substantially larger than the size of the display screen of a Techtronics 5103N oscilloscope or equivalent, which facilitates applications in which the display may be employed as feedback device for the subject.

Figure 4:
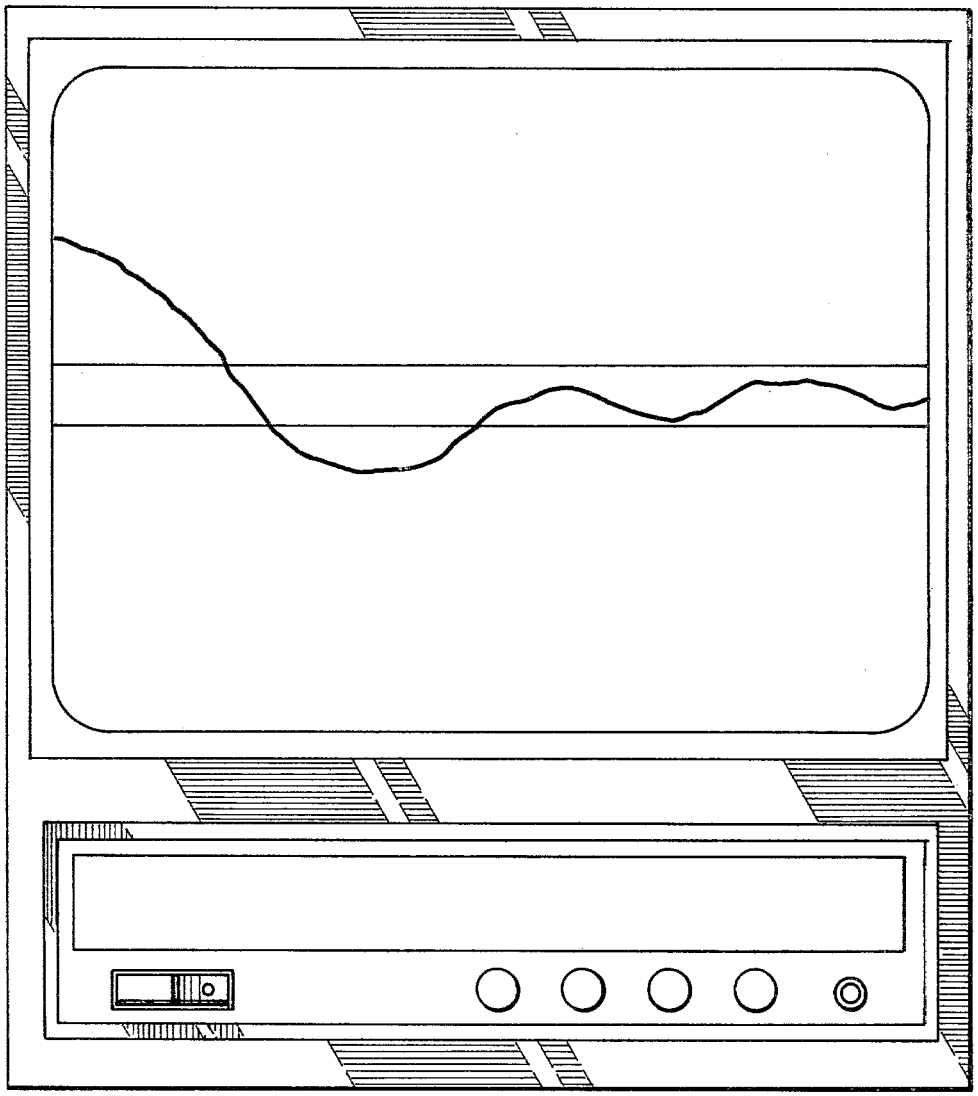

Shown in FIG. 4 is a typical display provided during calibration of the nasalization transform. Two horizontal target lines extend across the screen. The calibration procedure is initiated by typing 'C' on the control panel. As the subject produces a sustained /m/, the directional microphone is adjusted so that its face is positioned toward the lips but away from the nares, until the trace which sweeps the screen is at its lowermost deflection during phonation. Then, as the subject produces a sustained /a/, the microphone gain control is adjusted until the moving trace which traverses the display falls between the target lines. After the microphone position and gain has been adjusted in this manner, the next portion of the calibration procedure is initiated by depressing the space bar on the control panel. Then, as the subject produces a sustained /m/, the accelerometer gain control is adjusted until the moving trace falls between target lines displayed on the screen. After completion of this adjustment, calibration is terminated by depressing the space bar a second time.

Other transforms of the speech signal may also be acquired to form a plot which can be traversed by a moving cursor synchronously with the replayed audio signal associated with the plot of the transform. A plot of intensity can be obtained by sampling the logarithmic output of RMS converter 24 on the microphone channel. In addition, any transform derived from an external device which provides a voltage output related to shifts in the transform can be input through auxiliary input 32. For example, the Kay Elemetrics 6087 pitch analyzer can be employed to provide an output which is transferred to auxiliary input 32 to permit formation of a plot of the pitch contour of the speech signal on display 52. The graphic plots of intensity or fundamental frequency formed by this means can be swept by a moving cursor synchronously with the replayed audio signal in the same manner as that described for the graphic plot of nasalization.

The software which drives the hardware described consists of four main sections: a command processor, data acquisition, the main display and speech playback routine, and a collateral processor. The overall flow of the program is found in FIG. 5A. The program waits until a keyboard command is received by the command processor. A data acquisition command causes the raw speech signal and a selected transform of the speech signal to be acquired essentially simultaneously. As the transform is acquired it is displayed as a graphic plot which traverses the display screen. A command input from the keyboard as this process is occurring stores the speech and transform values acquired until memory allocated for storage is filled. Speech and transform storage pointers are employed to index memory locations in the speech and transform storage records. When memory allocated for data storage is filled, the program enters the main display and speech playback routine. A moving cursor can then be swept across a display of the graphic plot synchronously with the replayed raw speech signal associated with the graphic plot, or collateral processors can be requested. Collateral processes include a display of the available command menu, digital processing of the graphic plot of the transform, and calibration routines.

Figure 5A:
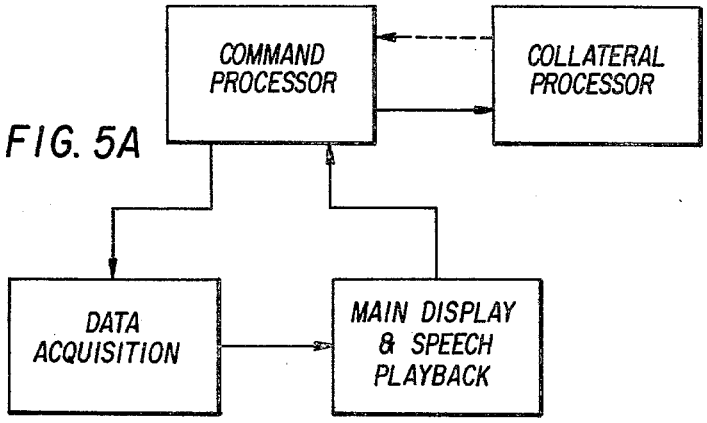
Figure 5B:
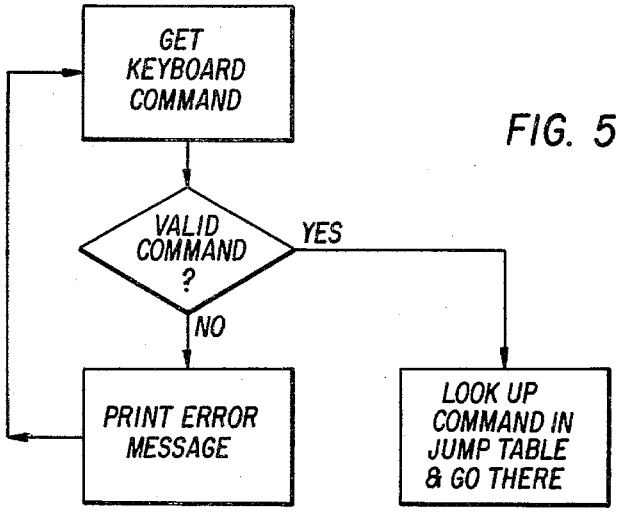

Details of the command processor are found in FIG. 5B. The routine accepts a keyboard input, processes the input to determine if it is a valid command, prints an error message if it is not, and jumps to the appropriate routine otherwise. The command processor permits user control of all routines which are initiated by the user.

Figure 5C:
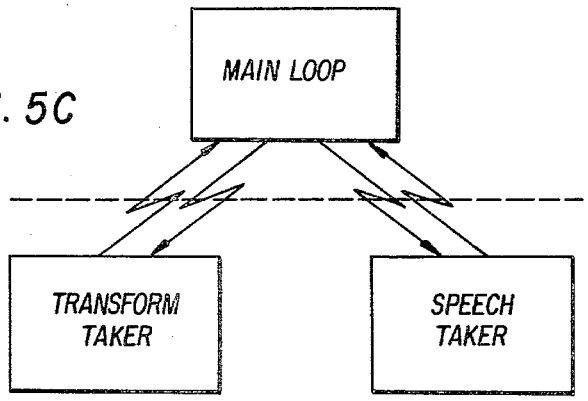

The overall flow of the data acquisition routine referred to in FIG. 5A is found in FIG. 5C. The main loop of the data acquisition routine is interrupted by the transform taker and by the speech taker. Speech interrupts have priority over transform interrupts. Speech interrupts may occur during transform acquisition or processing, but the transform taker may not interrupt the speech taker. When a new transform point has been acquired, the main loop plots the transform point on the display screen. Programmable speech and transform timers in hardware are initialized in the main loop to control the rates at which interrupts are generated for data acquisition. It is possible to code the program with a single interrupt and timer, but efficiency is improved by employing both a speech timer and a transform timer, and dual interrupts.

The overall flow of the main display and speech playback routine referred to in FIG. 5A is found in FIG. 5D. This routine graphically plots the transform values acquired, and permits control of a cursor which traverses the graphic plot synchronously with the replayed speech signal. The main loop of this routine graphically plots the transform values and then cycles into the transform-cursor routine. The transform-cursor routine permits initiation of transform-cursor movement across the graphic plot by means of the transform-cursor toggle in external hardware. When the transform-cursor toggle is held to the right, the transform-cursor moves across the graphic plot to the right. Receipt of a cursor-right command from the transform-cursor toggle on the control panel results in simultaneous initiation of the speech and transform timers. The speech timer controls the rate at which the raw speech signal is replayed, and ensures that the signal is replayed at the same rate at which it was acquired. The transform timer moves the transform-cursor from point to point on the graphic plot at the same rate at which the original transforms were acquired. In this manner synchrony between the replayed raw speech signal and movement of the transform-cursor across the plot of the transform is maintained. This process is terminated when the transform-cursor toggle is released to the middle cursor-halt position. A cursor-left command from the transform-cursor toggle reverses the process, except that the backward-played raw speech signal is not output to the digital-to-analog converter which drives the speaker, while the speech signal associated with the transform values traversed is output for a rightward movement of the transform cursor. When the transform-cursor toggle is in the halt position, the transform-cursor routine periodically polls the command processor for additional commands input from the keyboard.

Details of the data acquisition section of the program are shown in FIG. 6. The main loop of the data acquisition routine, referred to in FIG. 5C, is shown in detail in FIG. 6A. The main loop is an interrupt-waiting routine which updates the graphic display when a new transform value is acquired. It establishes interrupt vectors for speech and transform interrupts, initializes the speech and transform interrupt timers, and waits for interrupts which control acquisition of new transform and speech values. If a new transform value has been acquired, it is plotted on the graphic diaplay screen. After a transform-ready flag has been detected in the main loop, all subsequent code associated with plotting the transform value must be executed before the next transform interrupt occurs. Speech interrupts may occur at any point in the loop. When the raw speech storage record is filled, the timers are turned off, interrupts disabled, and the main loop exits to the main display and speech playback routine referred to in FIG. 5D.

Since several speech interrupts may occur while a transform value is plotted, the main loop may not detect that the speech storage record has been filled until it overflows. Therefore a buffer is necessary at the end of the speech storage record. The length of the buffer must be equal to or greater than the maximum number of speech interrupts which may occur between speech interrupts.

Figure 6B:
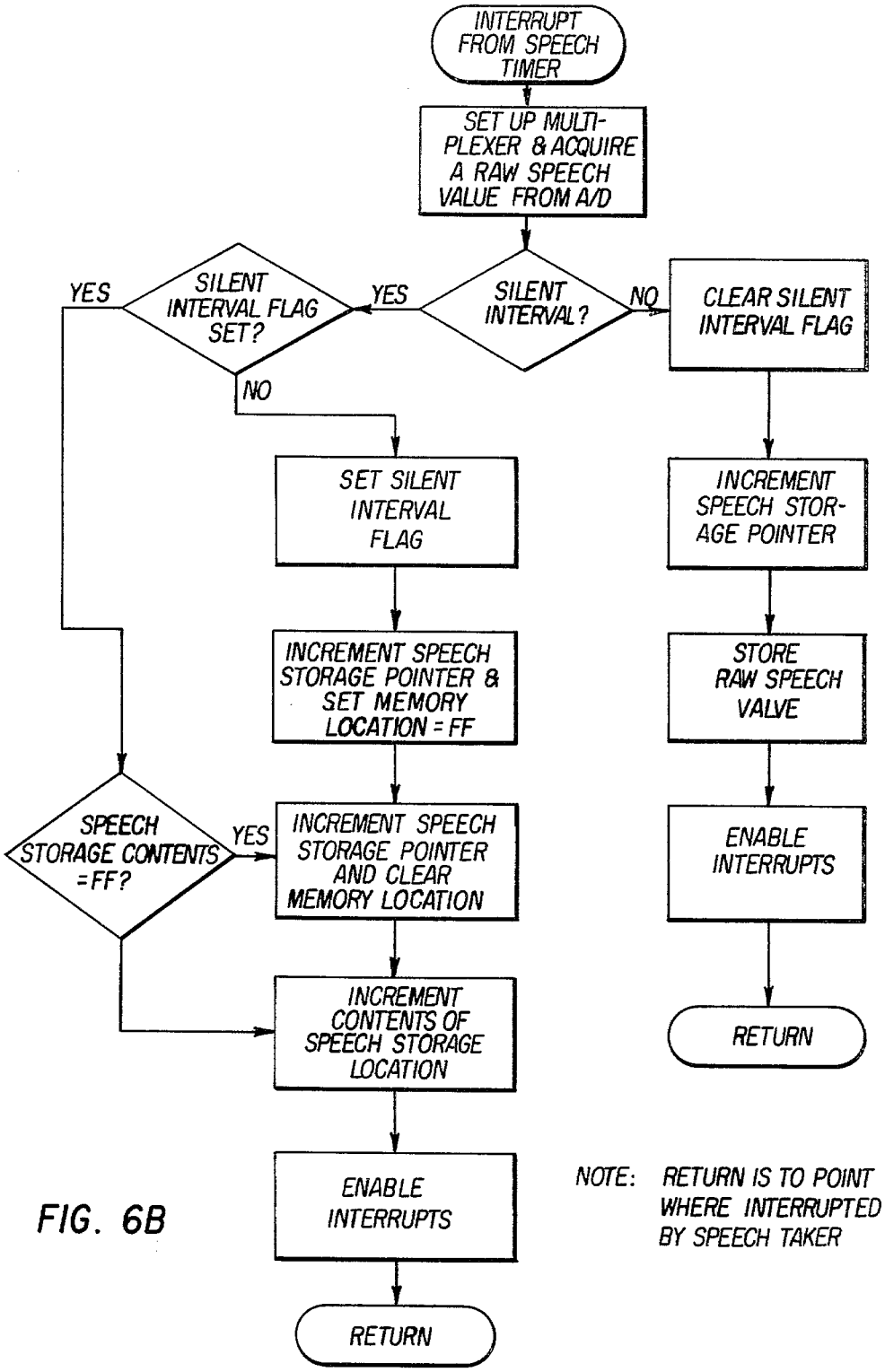

Details of the interrupt-driven speech taker are found in FIG. 6B. When an interrupt from the speech timer indicates that a new raw speech value should be acquired, the speech taker first sets the multiplexer to the raw speech channel and acquires a raw speech value digitized by the eight-bit analog-to-digital converter. Next it determines whether the sample was acquired in a silent interval through comparison with a preset threshold. If the sample was not acquired during a silent interval in the speech signal, the routine increments the speech storage pointer, stores the value as an eight-bit binary number which fills one byte of the speech storage record, enables interrupts, and returns.

However, when values acquired from the speech channel drop below a threshold which indicates silence on that channel, the silent interval is coded rather than stored as an eight-bit number. A value of FF hexadecimal in the raw speech storage record acts as a flag which indicates that the succeeding byte in memory is a counter which contains the number of silent (below threshold) values acquired consecutively on the raw speech channel. When the counter created in this manner reaches a value of FF, a second counter is established in the next succeeding byte, and so on. Therefore, when a below-threshold value is acquired on the raw speech channel, the speech taker first determines if the silent interval flag is set. If the silent interval flag is not set, the speech storage pointer is incremented and the location in the speech storage record to which it points is set to FF. The speech storage pointer is incremented again, and the next memory location (which will now act as a silent interval counter) is cleared and incremented by one before the routine reenables interrupts and returns. If a silent value is acquired from the raw speech channel and the silent interval flag has already been set, this indicates that the proceding speech sample also occurred during a silent interval and that the current location in the speech storage record must be a silent interval counter preceded by an FF. If so, the speech taker determines if the silent interval counter is full. If the current silent interval counter is full, the speech taker increments the speech storage pointer by one, clears a new silent interval counter, increments it by one, enables interrupts and returns. If the current silent interval counter is not full, the routine simply increments the counter by one, enables interrupts, and returns. This approach substantially reduces the amount of memory which must be utilized to store the raw speech signals. Note, however, that the analog-to-digital converter must never yield a value of FF hexadecimal if this approach is employed. This may be accomplished by clamping the output of the signal from the amplifier preceding the analog-to-digital converter to a range slightly less than the full range of the analog-to-digital converter.

Figure 6C:
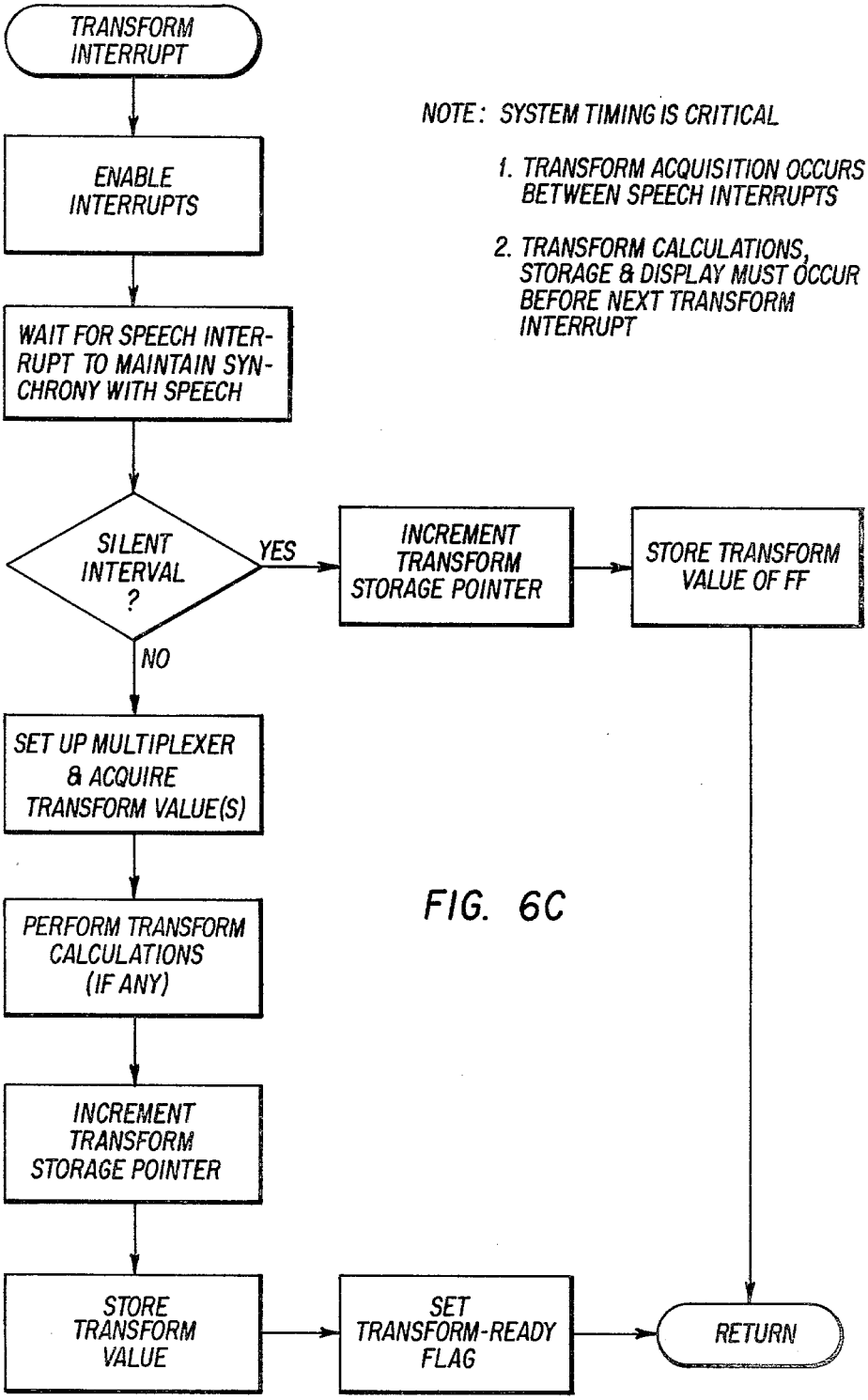

The general structure of the transform taker is found in FIG. 6C. When an interrupt is generated by the transform timer, the transform taker reenables interrupts and waits until an interrupt from the speech timer is processed to ensure that timing of the acquisition of the transform always stands in known relationship to the speech sample. System timing is critical during the transform acquisition routine. Acquisition of the value or values which will be employed to form a transform must be completed before the next speech interrupt occurs. Waiting until a speech interrupt occurs and is processed to initiate the transform acquisiton routine also ensures that the maximum time between speech interrupts is always provided. All computations or display tasks associated with forming and displaying the transform must be completed before the next transform interrupt occurs. If more than one channel of the multiplexer must be sampled to acquire the values required for formation of the transform, each value may be acquired between successive sets of speech interrupts if there is not sufficient time to acquire all values between a single pair of speech interrupts. This presupposes that the resulting time skew between acquisition of successive values employed to form the transform is noncritical.

After consecutive transform and speech interrupts occur, the transform taker first tests the current silent interval flag (set in the speech taker). If the silent interval flag is set no signal was present on the raw speech channel when the last speech sample was acquired. Since a speech transform value acquired in the absence of a raw speech signal is essentially meaningless, the transform taker increments the transform storage pointer, stores a value of FF hexadecimal at the current location of the transform storage record to indicate an invalid transform value, and returns. If the silent interval flag is not set, the transform taker selects the appropriate channel on the multiplexer and acquires a value from the analog-to-digital converter. This process is repeated until all values required for formation of the transform are completed. It then performs whatever calculations may be required for formation of the transform. The transform taker than increments the transform storage pointer, stores the transform value in the memory location currently pointed to by the transform storage pointer, sets the transform ready flag, and returns. Note that the memory area allocated for storage of the raw speech values must be filled before the area allocated for storage of the transform values, since the main loop terminates when the memory area for storage of the raw speech values is completed. If the area allocated for storage of the transform values is filled first, this data record will overflow.

The transform pointer can also be accessed by the main loop of the data acquisition routine shown in FIG. 5B, and in greater detail in FIG. 6A. The transform taker sets a flag for the main loop when storage of a valid transform value has been completed. The main loop then accesses the transform pointer to obtain the location of the transform value it must obtain to place the next point in the transform plot on the display screen.

Figure 6D:
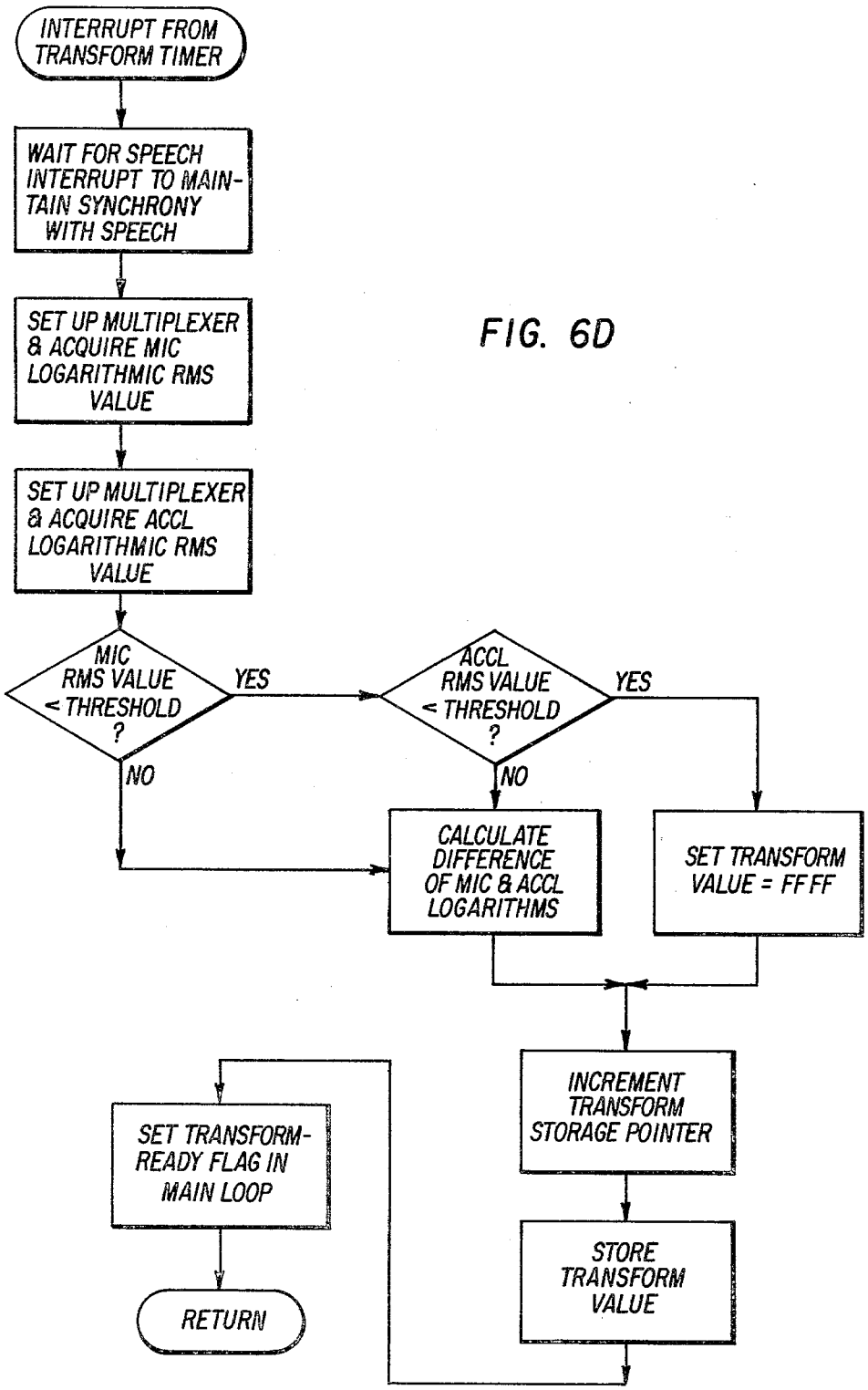
Figure 6E:
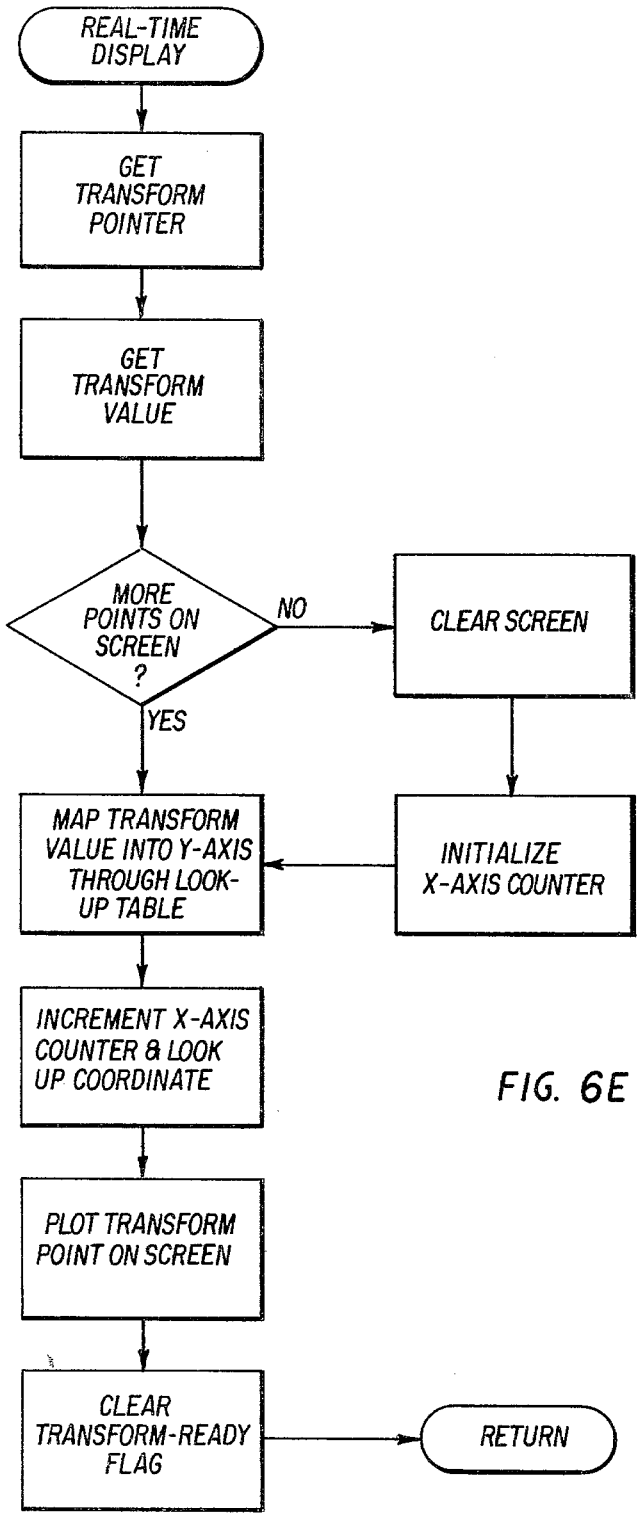

Details of the specific transform acquisition routine employed for formation of the logarithmic nasalization transform are found in FIG. 6D. If the log transform option has been enabled through the command processor, the logarithmic outputs of the accelerometer and microphone RMS circuits are acquired through selection of the appropriate multiplexer channels. The transform is formed as the logarithmic ratio of the accelerometer and the microphone values, and stored as a two-byte value in memory. In this particular instance, it is assumed that if both values fall below a specified threshold, the transform will be invalid. If both RMS values fall below the thresholds set, the transform value is coded as FF FF hexadecimal to indicate that the transform is invalid. If one of the RMS values exceeds the respective threshold set, the ratio of the two values is formed and stored.

In the instance of the linear nasalization transform, the general transform taker is employed for data acquisition. The linear outputs of the two RMS converters are transferred to a one-quadrant divider circuit which provides the arithmetic ratio of the outputs. If the linear transform option has been enabled through the command processor, the output of the divider circuit is sampled through selection of the appropriate multiplexer to obtain the linear transform. After the nasalization ratio, whether linear or logarithmic depending upon the option enabled, has been formed, the ratio is stored and the routine returns to the main loop.

Details of the real-time transform display subroutine of the main loop are found in FIG. 6F. The main loop enters the transform display routine when the transform ready flag in the main loop (see FIG. 6A) is set by the transform taker. The value of the transform is obtained through reference to its storage location found in the transform storage pointer. After the value has been obtained, vertical screen coordinates are referenced through a look-up table. Horizontal screen coordinates are accessed through reference to an X-axis counter which supplies the coordinates and is incremented whenever a valid transform is plotted on the screen. When the screen is full, the counter rolls over. The rollover is detected by the transform display subroutine, which clears the screen in preparation for the next screen of data. The graphic display controller can be implemented by means of a Matrox ALT-256 or equivalent. Software to drive the graphic display controller is supplied with hardware. After the screen coordinate values are obtained, the values are input to the Matrox software routines to plot the point on the display screen, the transform ready flag is cleared to prevent repeated plotting of the same point, and the subroutine returns to the main loop.

When the speech storage record is filled, the data acquisition routine exits to the main display and speech playback routine referred to in FIG. 5A. This routine draws a plot of a portion of the stored transform, and permits movement of the transform-cursor across the plot synchronously with the replayed audio signal associated with the segment of the plot which the cursor is traversing. If the entire record of transform values is displayed on the display screen at a given time, the graphic plot is compressed to the extent that it may be difficult to interpret. Therefore, only a selected portion of the plot is displayed at a single time. Initially the first 256 points of the transform data record are plotted graphically. As the transform-cursor traverses the graphic plot in a rightward direction, it eventually reaches the right side of the display screen. When this occurs, the screen is cleaved, the next 256 points of the transform data record are plotted, and the cursor is repositioned on the left hand side of the screen. This process is reversed if the transform-cursor is traveling in a leftward direction. When the transform-cursor is traveling in a rightward direction, the speech associated with the graphic plot traversed is replayed synchronously with movement of the cursor.

Figure 7A:
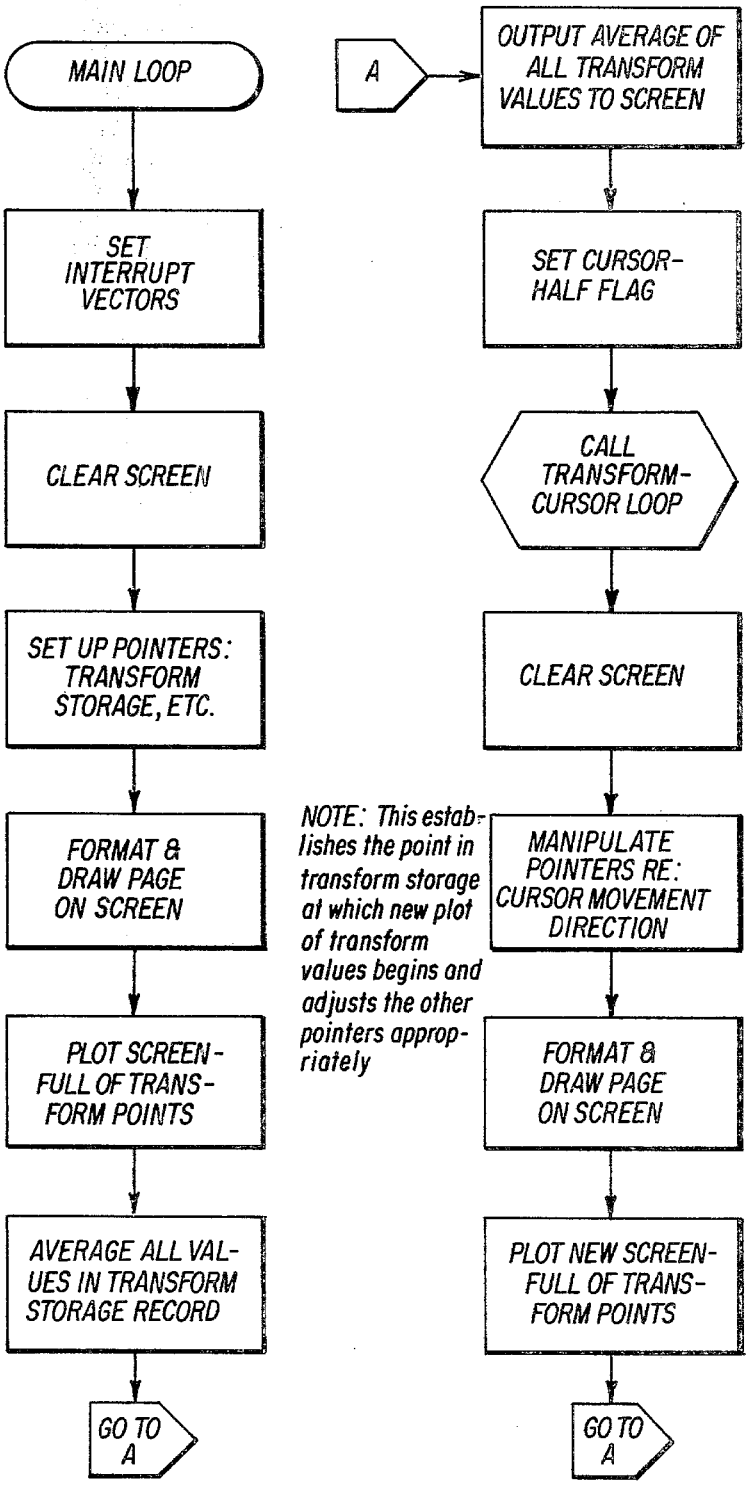
Figure 7B:
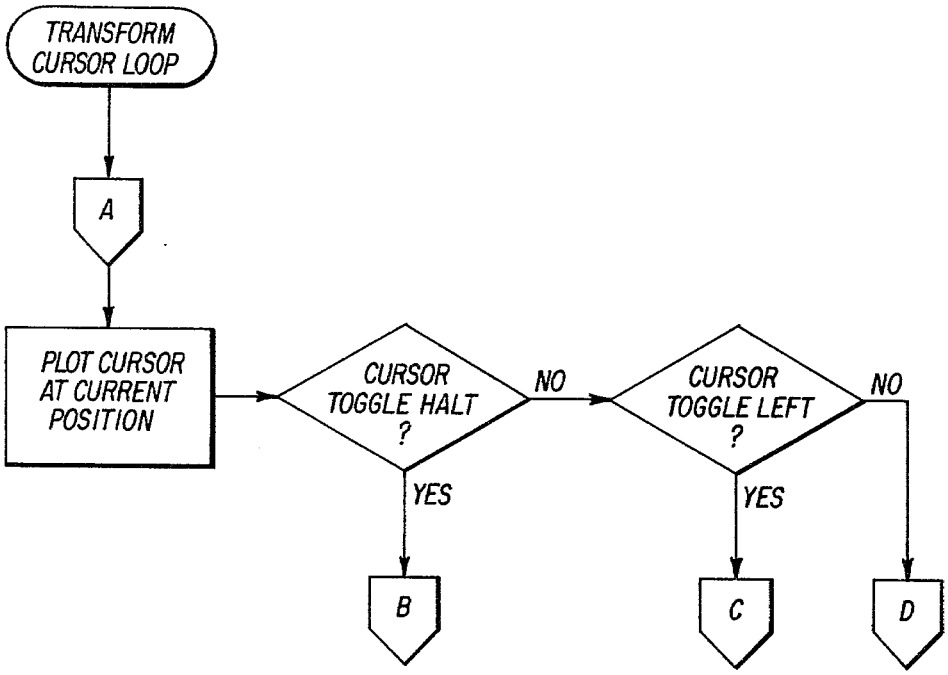
Figure 7C:
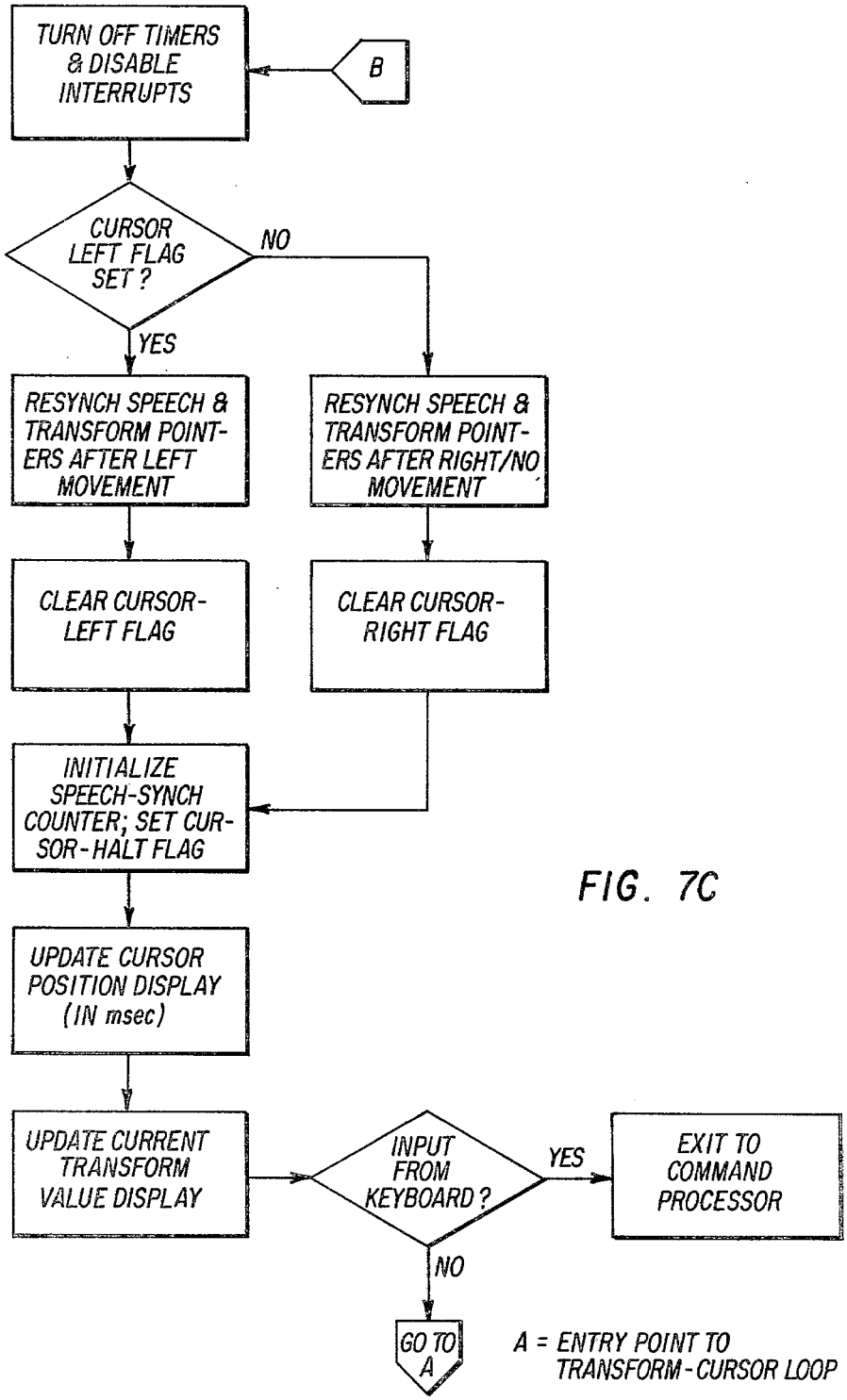
Figure 7D:
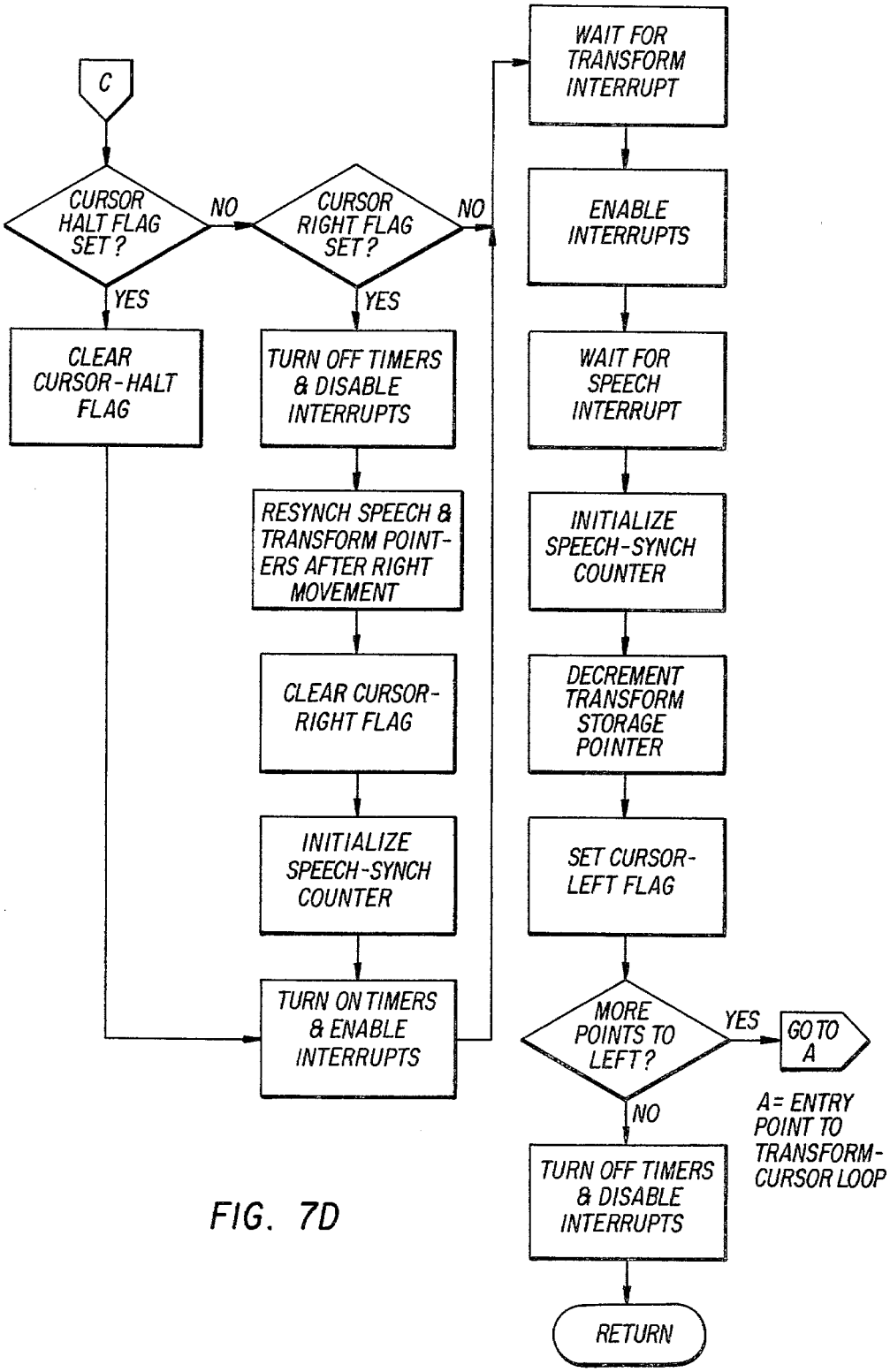
Figure 7E:
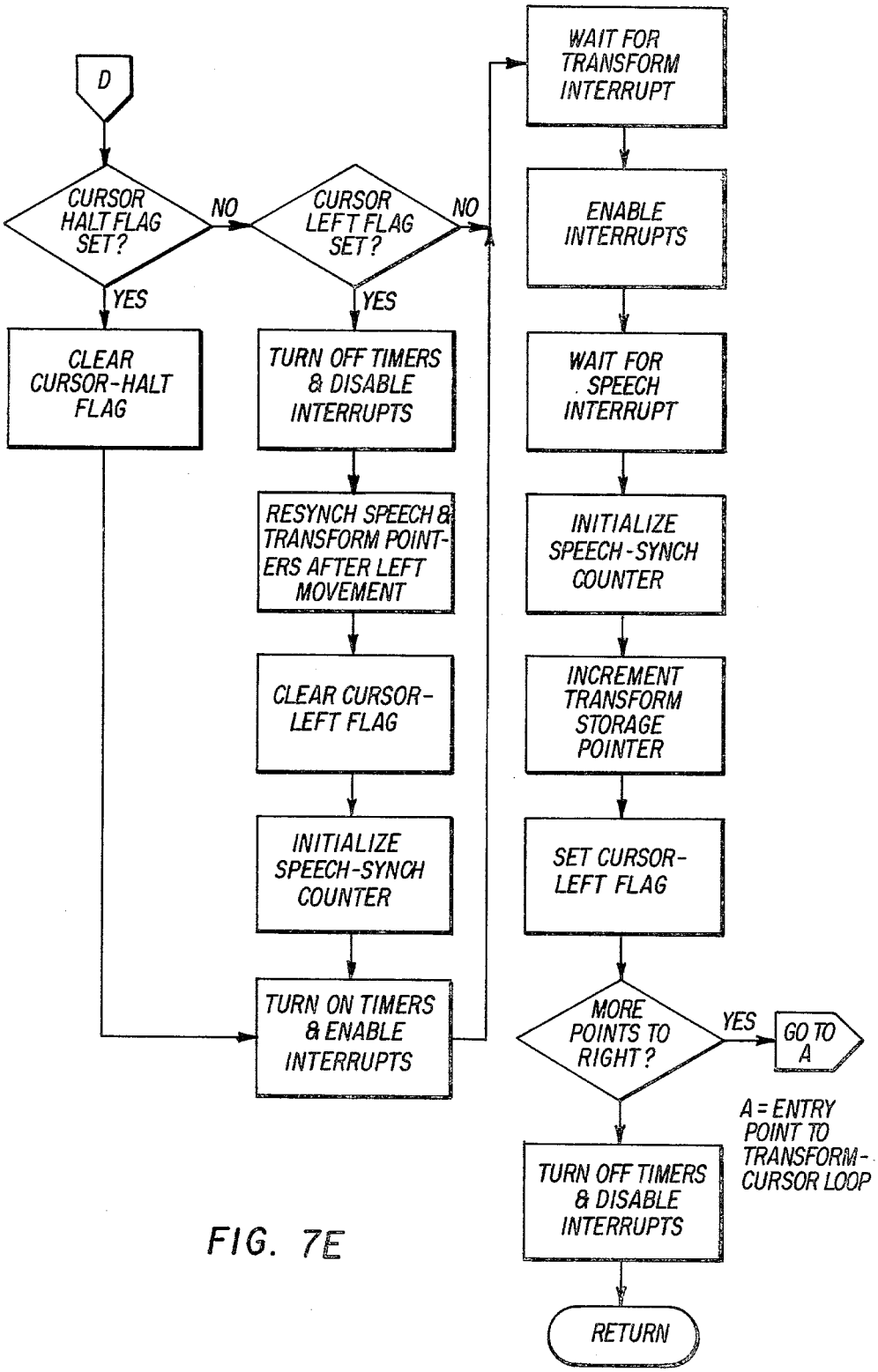

Details of the main loop of the main display and playback routine are found in FIG. 7A. The routine first sets interrupt vectors to access the proper routines when interrupts from the speech and transform timers are received. It next clears the screen of the display using the Matrox graphics subroutines and establishes pointers such as the transform storage pointer, the speech storage pointer, and the X-axis counter. The page format is then drawn on the screen, including the boundaries of the graphic plot and the graphic plot of the first screen's worth of data from the transform data record. The arithmatic average of the values of all transform points in the entire transform data record and displays this information in alphanumeric form on the screen using Matrox software routines to create the display. Since the transform-cursor is not moving when the transform cursor loop is entered, the cursor-halt flag is set to indicate this. The main display and playback routine then enters the transform-cursor loop, which controls transform-cursor movements.

Details of the transform-cursor loop are found in FIGS. 7B–7E. The transform-cursor loop first plots the current location of the transform-cursor through reference to the X-axis counter and the transform storage pointer. When halted, the transform-cursor is positioned just above the current transform value plotted as a point on the screen. The routine then tests the status of the transform-cursor toggle, and determines whether it is in the cursor-right, cursor-left, or cursor-halt position.

When a cursor-right command is received from the transform-cursor toggle on the control panel, the cursor-right subroutine of the transform-cursor loop first tests the cursor-halt flag to determine if the transform-cursor was halted prior to entry into the subroutine. If the transform-cursor was halted prior to entry, the speech and transform timers are simultaneously initiated. The speech timer controls the rate at which the raw speech signal is replayed, and ensures that the speech signal is replayed at the same rate at which it was acquired. The transform timer controls the rate at which the transform-cursor moves from point to point on the graphic plot, and ensures that the transform-cursor traverses the transform points plotted graphically at the same rate at which the original transform signals were acquired. In this manner synchrony between the replayed raw speech signal and movement of the transform-cursor across the plot of the transform are maintained.

After the timers are turned on, interrupts from the timers are enabled, and the cursor-right subroutine of the transform cursor loop waits for an interrupt from the transform timer. When a transform interrupt is received, the cursor-right subroutine reenables interrupts, waits for an interrupt from the speech timer to ensure that synchrony between transform-cursor movement and speech playback is maintained, and initializes the speech-synchrony counter. It then increments the transform storage pointer and sets the cursor-right flag before testing whether the right hand side of the screen has been reached. If the end of the screen has been reached, the subroutine returns to the main loop of the main display and speech playback routine, which takes note of the rightward direction of travel, plots the next 256 points in the transform storage record, and adjusts all affected pointers before reentering the transform-cursor loop.

Otherwise, the cursor-right subroutine loops back to the beginning of the transform-cursor loop, which plots the transform-cursor at its new position and rechecks the status of the transform-cursor toggle. If the transform-cursor toggle remains in the cursor-right position, the cursor-right subroutine is reentered. System timing is critical because all code associated with a transform interrupt must be executed before the next transform interrupt occurs.

Entry into a left or right cursor-movement subroutine of the transform-cursor loop is slightly different after a change in direction of the transform-cursor movement. Turning on the speech and transform timers in a cursor-movement subroutine causes the speech playback routine to be driven by interrupts from the speech timer. Since speech interrupts are assumed to occur at a faster rate than transform interrupts, the speech storage pointer is left at an indeterminate point with respect to the transform storage pointer after a change of direction. For that reason, a speech synchrony counter is incremented after each speech interrupt and reinitialized after each transform interrupt, making it possible to track the number of speech interrupts which have occurred since the last transform interrupt. The cursor-movement subroutines detect changes of direction by means of the cursor-right and cursor-left flags set in those subroutines. If a change of direction is detected the timers are turned off and interrupts disabled. The speech synchrony counter is then checked and the speech storage pointer is decremented or incremented (depending on whether the previous direction of transform-cursor movement was right or left) by the number of speech interrupts which have occurred since the last transform interrupt. The speech synchrony counter is then initialized and the timers are turned back on before reenabling interrupts.

The cursor-left subroutine of the transform cursor-loop is similar to the cursor-right subroutine except for the fact that in the cursor-left routine the transform pointer in decremented rather than incremented after each transform interrupt. Also, the cursor-right flag is set just prior to an exit from the cursor-right subroutine, while the cursor-left flag is set just prior to exit from the cursor-left subroutine.

When the transform-cursor toggle is in the cursor-halt position, the cursor-halt subroutine of the transform-cursor loop is entered. This routine turns off the timers and disables interrupts. It then tests whether there was transform-cursor movement to the left or right prior to entry into the routine, and readjusts the speech storage pointer accordingly through reference to the speech synchrony counter. The speech synchrony counter is initialized and the cursor-halt flag is set. The distance in milliseconds of the transform-cursor from the beginning of the stored utterance is calculatec and displayed on the screen in alphanumeric form. The value of the transform point at the current transform-cursor position is also displayed. The command processor is then polled to determine if any commands have been input from the keyboard. At this point commands implemented in the collateral processor can be initiated, or the data acquisition routine can be reentered. Otherwise the beginning of the transform-cursor loop is reentered.

Figure 7F:
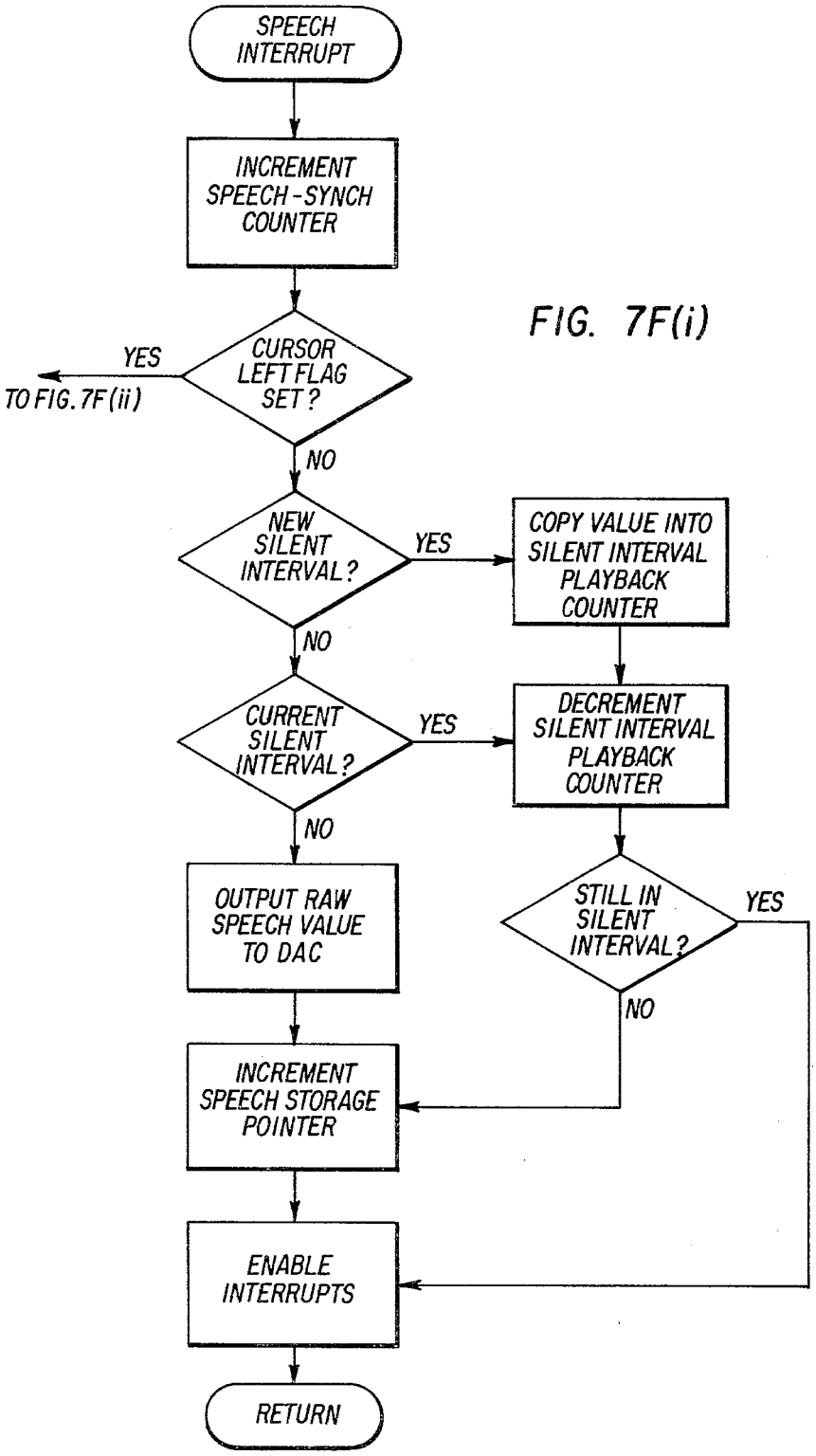

When the cursor-right or cursor-left subroutines are entered, the speech timer is also turned on and enabled synchronously with the transform timer. The speech timer invokes the speech playback subroutine found in FIG. 7F. When an interrupt is received, the speech synchrony counter is incremented by one. The routine then tests whether the transform-cursor movement is to the left or right through reference to the cursor-left and cursor-right flags set in the cursor-left and cursor-right subroutines of the transform-cursor loop (FIGS. 7B–7E). If transform-cursor movement is to the right, the speech playback routine next determines if the speech pointer is at the beginning of a silent interval. If so, the value of the silent interval is copied into the silent interval playback counter which is decremented by one. If the speech pointer is not at the beginning of a new silent interval, the routine determines whether the speech pointer is in a current silent interval, and if so, decrements the silent interval playback counter by one. The routine then determines whether the silent interval playback counter is now zero, and returns if it is not. If it is, the speech pointer is incremented by one before returning. If the speech pointer is not at a silent interval when the speech playback routine is entered, the routine simply outputs the current raw speech value to a digital-to-analog converter which drives a speaker and increments the speech storage pointer by one before returning.

The process which occurs when the speech playback routine detects a transform-cursor movement to the left is similar to that for a movement to the right except that the speech pointer is decremented rather than incremented, and the raw speech values which the speech pointer indexes are not output to the digital-to-analog converter which drives the speaker.

A change of direction in the transform-cursor loop which occurs when the speech pointer is in a silent interval requires special handling. In this instance, the silent playback interval counter, rather than the speech pointer, is decremented or incremented (depending on whether the previous direction was to the right or left) by the value of the speech synchrony counter. The process then proceeds in the manner described above.

The collateral processor handles a number of commands input from the keyboard. A list of all available commands can be requested, the range displayed on the vertical axis can be adjusted, the transform storage record can be subjected to digital filtering to smooth the display, or, in the instance of the nasalization transform, the data acquisition routine can be set for acquisition of either a linear or logarithmic transform. The routines which permit the user to calibrate the microphone and accelerometer RMS levels for acquisition of the nasalization transform are also found in the collateral processor. Two horizontal target bars are displayed on the screen as a real-time graphic plot of the microphone or accelerometer RMS level traverses the screen from left to right. This permits the user to adjust the microphone or accelerometer RMS level as the subject produces a sustained /a/ or /m/ respectively until the plot traversing the screen falls within the two target lines. The microphone calibration display also permits the user to adjust the tilt of the directional microphone while the subject produces a sustained /m/ until the microphone RMS level is minimal. Routines for calculation of rate of shift from a nasalized to a non-nasalized phoneme, or vice versa, are also found in the collateral processor. When the user aligns the transform-cursor with the beginning of the shift, the contents of the transform-storage pointer and the value of the transform pointed to by the transform-storage pointer are copied. The same information is similarly copied when the cursor is aligned with the end of the shift. The absolute value of the initial transform value at the beginning of the shift minus the transform value at the end of the shift is then computed and divided by the time in milliseconds between the first and second transform values.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for the acquisition of a raw speech signal and essentially simultaneous acquisition of a transform of the speech signal, wherein said transform covaries as a function of changes in one or more parameters in the speech signal, comprising:

microphone means for producing first signals representative of raw speech;

means for generating second signals essentially simultaneous to the production of said first signals, said second signals indicative of a selected parameteric characteristic of the human speech;

data processing means coupled to said microphone means and said second signal generating means for analyzing said first and second signals to produce transform signals based thereon;

display means for providing videographic and alphanumeric display of said transform signals and for synchronously auditorily displaying said first signals amplifying means for amplifying said first and said second signals to produce respective third and fourth signals based on the RMS average of said first and said second signals; and means for coupling said first, second, third and fourth signals to said data processing means; and said data processing means comprising, a memory for storing said first, second, third and fourth signals, means for producing first display signals based on selected of said second, third, fourth and transform signals generated over a predetermined time period, said data processing means applying said first display signals to said display means where said first display signals are displayed as a static graphic plot, means for generating a cursor for display by said display means such that said cursor traverses said static plot, and means for synchronously reading-out said memory respective first signals acquired essentially simultaneously with the selected signals represented in that portion of said static graphic plot being traversed by said moving cursor; and means for auditorily displaying said respective first display signals.

2. An apparatus according to claim 1, wherein said coupling means comprises:

multiplexer means under the control of said data processing means for selectively sampling said first, second, third and fourth signals; and conversion means for digitizing the output of the multiplexer means for subsequent processing by said data processing means.

3. An apparatus according to claim 1, further comprising:

means for halting said cursor;

means for generating second display signals representative of the numeric value of the selected signal of said static graphic display at the point at which the moving cursor is halted; and said display means comprising alphanumeric display means for displaying said second display signals.

4. An apparatus according to claim 3, further comprising:

means for generating third display signals representative of the time elapsed from the beginning of a recorded utterance to the point in time represented by the halted cursor;

said display means comprising alphanumeric display means for displaying said third display signals.

5. An apparatus according to claim 4, further comprising:

means for generating and displaying fourth display signals representative of an average of said transform signals stored in said memory over a predetermined time period.

6. An apparatus for the acquistion of a raw speech signal and the essentially simultaneous acquisition of a transform of the speech signal, wherein said transform covaries as a function of changes in one or more parameters in the speech signal, comprising:

microphone means for producing first signals representative of raw speech;

means for generating second signals essentially simultaneous to the production of said first signals, said second signals indicative of a selected parameteric characteristic of the human speech;

data processing means coupled to said microphone means and said second signal generating means for analyzing said first and second signals to produce transform signals based thereon; and display means for providing videographic and alphanumeric display of said transform signals and for synchronously auditorily displaying said first signals;

said data processing means comprising an addressable table memory for storing predetermined perceptual correlate numbers, each of which corresponds to respective ranges of said transform signals;

said display means comprising alphanumeric display means for displaying the perceptual correlate number corresponding to the average of the transform signals formed for a given recorded utterance; and said data processing means comprising mode select means for selecting selected of said display signals for display.

7. An apparatus according to claim 6, wherein said display means comprises:

a cathode ray tube display for providing the videographical and alphanumeric display of said display signals; and loudspeaker means for reproducing the raw speech represented by said first signals synchronously with the movement of said cursor across said static graphic plot such that as said cursor traverses said plot, said loudspeaker means reproduces raw speech associated with that portion of said plot being traversed by said cursor.

8. An apparatus according to claims 1, 2, 3, 4, 5, 6 or 7, further comprising:

said second signal generating means comprising accelerometer means for producing second signals indicative of nasal wall vibration occurring during human speech.

9. An apparatus according to claims 1, 2, 3, 4, 5, 6 or 7, further comprising:

said second signal generating means comprising pitch analyzing means for producing second signals indicative of the fundamental frequency of the raw speech.

10. An apparatus according to claims 1, 2, 3, 4, 5, 6 or 7, further comprising:

said second signal generating means comprising intensity analyzing means for producing second signals based on the peak amplitude of the raw speech.

11. An apparatus according to claim 8, further comprising:

said data processing means forming said transform signals based on the ratio of said third and fourth signals.

12. An apparatus according to claim 11, further comprising:

said data processing means forming said transform signals equal to the logarithmic ratios of the RMS values of said first and second signals.

13. An apparatus according to claim 11, further comprising:

said microphone means comprising a directional microphone having an output and adapted to be placed at a predetermined distance from the mouth of the patient;

said amplifying means comprising a microphone gain adjustable averaging circuit for producing said third signals based on the RMS average of the microphone output, wherein the gain of said microphone averaging circuit is calibrated such that said microphone averaging circuit produces third signals having a predetermined output level when the patient produces a non-nasal vowel;

said accelerometer means comprising an accelerometer having an output and adapted to be mounted in contact with the nose of the patient;

said amplifying means further comprising an accelerometer gain adjustable averaging circuit for producing said fourth signals based on the RMS average of the accelerometer output, wherein the gain of said accelerometer averaging circuit is calibrated such that accelerometer averaging circuit produces fourth signals having a standardized output level when the patient produces a nasal consonant.

14. An apparatus according to claim 13, wherein said microphone means further comprises:

orientation adjustment means for adjusting the position of the directional microphone such that the output of the microphone averaging circuit is minimal during production of said nasal consonant.

15. An apparatus according to claim 13, further comprising:

said data processing means comprising, means for generating a first pair of target bars and a tracing corresponding to the output level of said third signals during calibration of said microphone gain adjustable averaging circuit, said first pair of target bars and said tracing coupled to and displayed by said display means, means for adjusting the gain of said microphone gain adjustable averaging circuit such that the displayed tracing of said third signals are adjusted to a standardized output level delineated by the boundaries of the target bars during production of said non-nasal vowel, means for generating a second pair of target bars and a tracing corresponding to the output level of said fourth signals during calibration of said accelerometer gain adjustable averaging circuit, said second pair of target bars and said tracing of said fourth signals coupled to and displayed by said display means, and means for adjusting the gain of said accelerometer gain adjustable averaging circuit such that the displayed tracing of said fourth signals are adjusted to a standardized output level delineated by the boundaries of the target bars during production of said nasal consonant.

16. An apparatus according to claim 13, further comprising:

control means for aligning said cursor for delineation of points corresponding to the beginning and end of transitions in a series of acquired ratios associated with shifts from production of nasal to non-nasal phonemes by the patient; and said data processing means comprising means for determining the rate of shift in the acquired ratios associated with transition from production of a nasal to a non-nasal phoneme;

said display means comprising a digital display for displaying said rate of shift in acquired ratios associated with transition from production of a nasal to a non-nasal phoneme.

17. An apparatus for the non-invasive measurement and display of nasality in the speech of a human patient, comprising:

microphone means for producing first signals indicative of the sound level occurring during patient speech;

accelerometer means for producing second signals indicative of nasal wall vibration occurring during patient speech, said first and second signals being concurrently produced;

data processing means for forming transform signals based on a predetermined arithmetic combination of said first and second signals and for producing at an output of said data processing means said transform signals; and display means for providing a video display of said transform signals and a synchronous audio display of the patient speech;

wherein said data processing means comprises, means for forming said transform signals based on an arithmetic log ratio of the RMS values of said first and second signals, a memory for storing said arithmetic ratios as said ratios are formed, and mode select means for selectively producing said transform signals either from said ratios as said ratios are formed in real time or from the ratios stored in said memory;

wherein said display means comprises;

a cathode ray tube display for graphically displaying said transform signals on a vertical axis versus time on a horizontal axis; and loudspeaker means for producing the audio display of the patient speech from which transform displayed by said cathode ray tube display were derived;

said apparatus further comprising:

said data processing means comprising an addressable table memory for storing predetermined perceptual correlate numbers, each of which corresponds to respective ranges of said transform signals; and said display means comprising a digital display for displaying the perceptual correlate number corresponding to the transform signals formed at a selected time.

18. An apparatus according to claim 17 wherein said data processing means further comprises:

means for generating display signals corresponding to a static graphic plot of said transform signals over a predetermined time period;

means for generating a moving cursor for video display by said display means, wherein said cursor traverses said static graphic plot over time;

means for generating raw speech signals corresponding to the patient speech associated with said static graphic plot;

means for synchronously outputting to said display means said static graphic plot, said raw speech signals and said moving cursor.

19. An apparatus for the non-invasive measurement and display of nasality in the speech of a human patient, comprising:

microphone means for producing first signals indicative of the sound level occurring during patient speech;

accelerometer means for producing second signals indicative of nasal wall vibration occurring during patient speech, said first and second signals being concurrently produced;

data processing means for forming transform signals based on a predetermined arithmetic combination of said first and second signals and for producing at an output of said data processing means said transform signals; and display means for providing a video display of said transform signals and a synchronous audio display of the patient speech;

said microphone means comprising:

a microphone having an output and adapted to be placed in the vicinity of the mouth of the patient; and a microphone gain adjustable averaging circuit for producing said first signal based on the RMS average of the microphone output, wherein the gain of said microphone averaging circuit is calibrated such that said microphone averaging circuit produces third signals having a maximal output level when the patient speaks a predetermined non-nasal vowel;

said accelerometer means comprising, an accelerometer having an output and adapted to be mounted in contact with the nose of the patient, and and accelerometer gain adjustable averaging circuit for producing said fourth signals based on the RMS average of the accelerometer output;

wherein the gain of said accelerometer averaging circuit is calibrated such that accelerometer averaging circuit produces fourth signals having a maximum output level when the patient speaks a predetermined nasal consonant.

20. An apparatus according to claim 19, further comprising:

said data processing means comprising, means for generating a first pair of target bars and a tracing corresponding to the output level of said third signals during calibration of said microphone gain adjustable averaging circuit, said first pair of target bars and said tracing coupled to and displayed by said display means, means for adjusting the gain of said microphone gain adjustable averaging circuit such that the displayed tracing of said third signals are adjusted to a standardized output level delineated by the boundaries of the target bars during production of said non-nasal vowel;

means for generating a second pair of target bars and a tracing corresponding to the output level of said fourth signals during calibration of said accelerometer gain adjustable averaging circuit, said second pair of target bars and said tracing of said fourth signals coupled to and displayed by said display means, and means for adjusting the gain of said accelerometer gain adjustable averaging circuit such that the displayed tracing of said fourth signals are adjusted to a standardized output level delineated by the boundaries of the target bars during production of said nasal consonant.

* * * * *